US008454796B2

(12) United States Patent
Reinicke

(10) Patent No.: US 8,454,796 B2
(45) **Date of Patent: *Jun. 4, 2013**

(54) MANUFACTURE OF FILLED PAPER

(75) Inventor: Holger Reinicke, The Hague (NL)

(73) Assignee: BASF SE, Ludwigshafen (DE)

( * ) Notice: Subject to any disclaimer, the term of this patent is extended or adjusted under 35 U.S.C. 154(b) by 202 days.

This patent is subject to a terminal disclaimer.

(21) Appl. No.: 12/525,081

(22) PCT Filed: Jan. 21, 2008

(86) PCT No.: PCT/EP2008/050648

§ 371 (c)(1),
(2), (4) Date: Dec. 7, 2009

(87) PCT Pub. No.: WO2008/095764

PCT Pub. Date: Aug. 14, 2008

(65) Prior Publication Data

US 2010/0089541 A1 Apr. 15, 2010

(30) Foreign Application Priority Data

Feb. 5, 2007 (GB) ..... 0702248.6

(51) Int. Cl.
*D21H 11/00* (2006.01)

(52) U.S. Cl.
USPC ..... 162/164.6

(58) Field of Classification Search
USPC ..... 162/164.6, 164.1, 177
See application file for complete search history.

(56) References Cited

U.S. PATENT DOCUMENTS

| | | | | |
|---|---|---|---|---|
| 4,385,961 | A | 5/1983 | Svending et al. | |
| 4,506,062 | A | 3/1985 | Flesher et al. | |
| 4,528,321 | A | 7/1985 | Allen et al. | |
| 4,599,379 | A | 7/1986 | Flesher et al. | |
| 4,720,346 | A | 1/1988 | Flesher et al. | |
| 4,753,710 | A | 6/1988 | Langley et al. | |
| 4,871,251 | A | 10/1989 | Preikschat et al. | |
| 5,167,766 | A | 12/1992 | Honig et al. | |
| 5,274,055 | A | 12/1993 | Honig et al. | |
| 5,431,783 | A | 7/1995 | Honig | |
| 5,603,805 | A | 2/1997 | Andersson et al. | |
| 6,083,348 | A | 7/2000 | Auhorn et al. | |
| 6,358,364 | B2 | 3/2002 | Keiser et al. | |
| 6,361,652 | B2 | 3/2002 | Keiser et al. | |
| 6,361,653 | B2 | 3/2002 | Keiser et al. | |
| 6,391,156 | B1 | 5/2002 | Hjalmarson et al. | |
| 6,395,134 | B1 | 5/2002 | Chen et al. | |
| 6,451,902 | B2 | 9/2002 | Campomizzi | |
| 6,616,806 | B2 | 9/2003 | I Chen | |
| 7,470,346 | B2 | 12/2008 | Donnelly et al. | |
| 8,168,040 | B2 * | 5/2012 | Reinicke | 162/164.6 |
| 2001/0023752 | A1 | 9/2001 | Keiser et al. | |
| 2003/0192664 | A1 | 10/2003 | Kulick | |
| 2008/0196852 | A1 | 8/2008 | Leduc et al. | |
| 2009/0050282 | A1 | 2/2009 | Faucher et al. | |

FOREIGN PATENT DOCUMENTS

| | | | |
|---|---|---|---|
| DE | 4436317 | A1 | 4/1996 |
| EP | 0 041 056 | A1 | 12/1981 |
| EP | 0 102 760 | A2 | 8/1984 |
| EP | 0 126 528 | A2 | 11/1984 |
| EP | 0 150 933 | A2 | 8/1985 |
| EP | 0 202 780 | A2 | 11/1986 |
| EP | 0 235 893 | A1 | 9/1987 |
| EP | 0 462 365 | A1 | 12/1991 |
| EP | 0 635 602 | A1 | 1/1995 |
| FR | 2869625 | A1 | 11/2005 |
| WO | 94/05596 | A1 | 3/1994 |
| WO | 95/23021 | A1 | 8/1995 |
| WO | 98/29604 | A1 | 7/1998 |
| WO | WO-0017451 | A1 | 3/2000 |
| WO | WO-0134908 | A1 | 5/2001 |
| WO | 2004/018768 | A1 | 3/2004 |
| WO | 2004/046464 | A1 | 6/2004 |
| WO | WO-2004088034 | A2 | 10/2004 |
| WO | 2005/116336 | A1 | 12/2005 |
| WO | 2007/031442 | A1 | 3/2007 |
| WO | 2007/048704 | A1 | 5/2007 |

OTHER PUBLICATIONS

English Language abstract of DE 4436317 from the esp@cenet web site printed on Sep. 21, 2009.

Great Britain Search Report dated Jul. 10, 2007.

Duoformer TQv, Voith trade publication p. 376 e 4000 Jun. 2002.

Magazin fur Papiertechnik (issue 6(1998), Bock et al.

Triple Star-Sappi Gratkorn GMBH, Voith trade publication p. 316 e, Jun. 1998, 4000 p. 7, col. 2, paragraph 3, figure 8.

Krogerus, "Laboratory testing of retention and drainage," pp. 83-93, p. 87 in Leo Neimo (ed), Papermaking Science and Technology, Part 4, Paper Chemistry, Fapet oy Jyvaskyla 1999.

(Continued)

*Primary Examiner* — Mark Halpern

(74) *Attorney, Agent, or Firm* — Drinker Biddle & Reath

(57) ABSTRACT

A process of making filled paper comprising the steps of providing a thick stock cellulosic suspension that contains mechanical pulp and filler, diluting the thick stock suspension to form a thin stock suspension, in which the filler is present in the thin stock suspension in an amount of at least 10% by weight based on dry weight of thin stock suspension, flocculating the thick stock suspension and/or the thin stock using a polymeric retention/drainage system, draining the thin stock suspension on a screen to form a sheet and then drying the sheet, in which the polymeric retention/drainage system comprises, i) a water-soluble branched anionic polymer and ii) a water-soluble cationic or amphoteric polymer. The process is particularly suitable for making filled mechanical grade paper, such as SC grade paper. The process enables the separation of retention and drainage parameters, especially useful for fast draining paper machines, such as Gapformers.

16 Claims, 13 Drawing Sheets

OTHER PUBLICATIONS

Blanco et al., "Focused Beam Reflectant Measurement as a Tool to Measure Flocculation," Chemical Engineering Department F. of Chemistry, Computense University of Madrid, 28040 Madrid (Spain), Papermaking conference, Mar. 2001, pp. 114-126.
Tappi Method T261 cm-94 "Fines Fraction of Paper Stock by Wet Screening", 1994.
Search Report dated Jun. 5, 2007, issued by UK Intellectual Property Office in British Application No. GB0702249.4.
Grossmann, Voith GMBH, Wochenblatt fur papierfabrikation (1993), 121 (19), 775-6-778,780-2.
"Advanced wire part simulation with moving belt former and its applicability in scale up on rotogravure printing paper" Strengell K. et al, J. in Pulp and Paper Canada 105(3)(2004), T62-66.
"Flocculation monitoring: focused beam reflectance measurement as measurement tool", Blanco et al., Journal of chemical Engineering (229), 80(4), 734-740, 1994.
Metso Paper USA, Annual Meeting, Pulp and Paper Tech. Association of Canada, 90th, Jan. 27-29, 2004, book A A109-112.

* cited by examiner

Figure 1: Fine paper furnish 1 with system E, drainage vs. ash
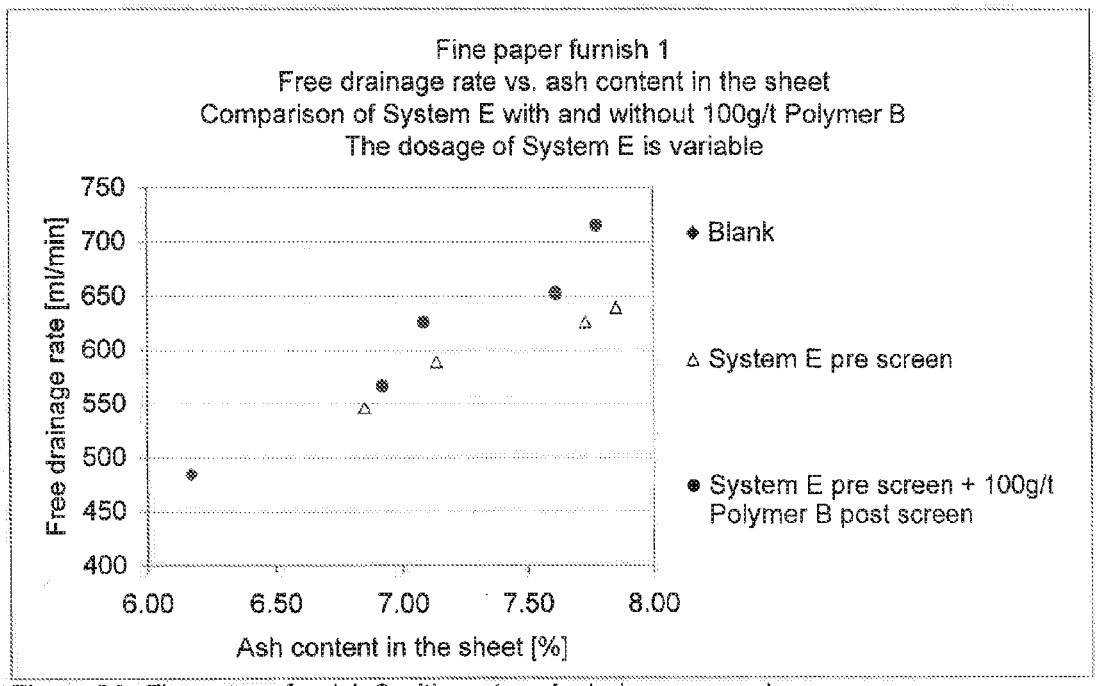
Figure 2A: Fine paper furnish 2 with system A, drainage vs. ash
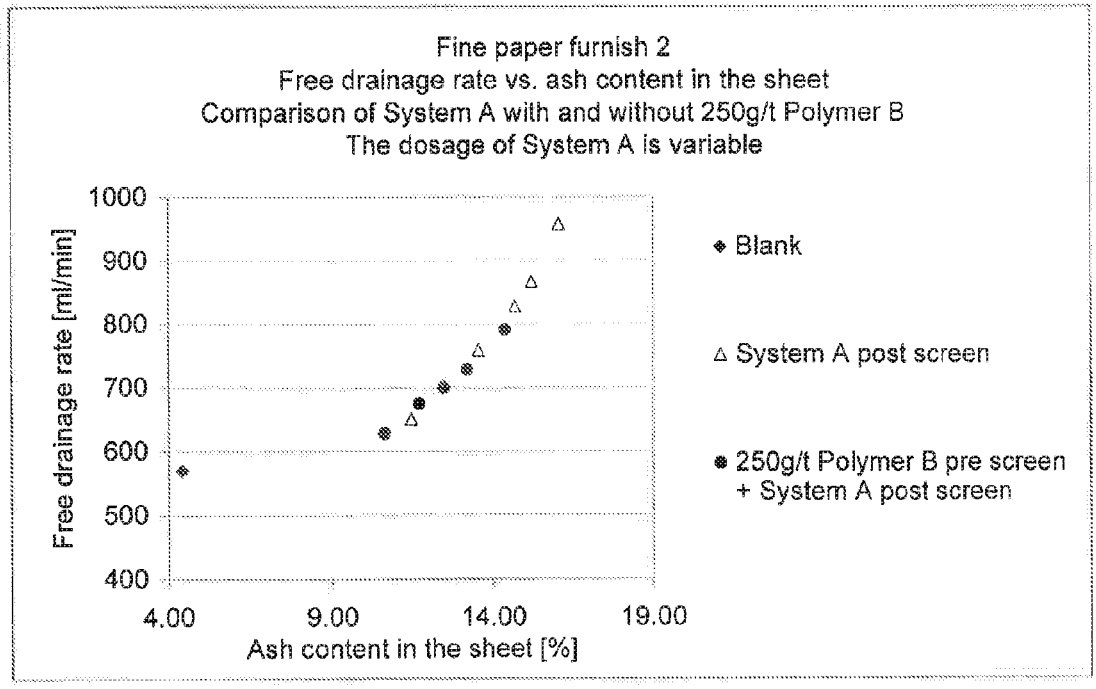

Figure 2B: Fine paper furnish 2 with system A, ash vs. polymer actives
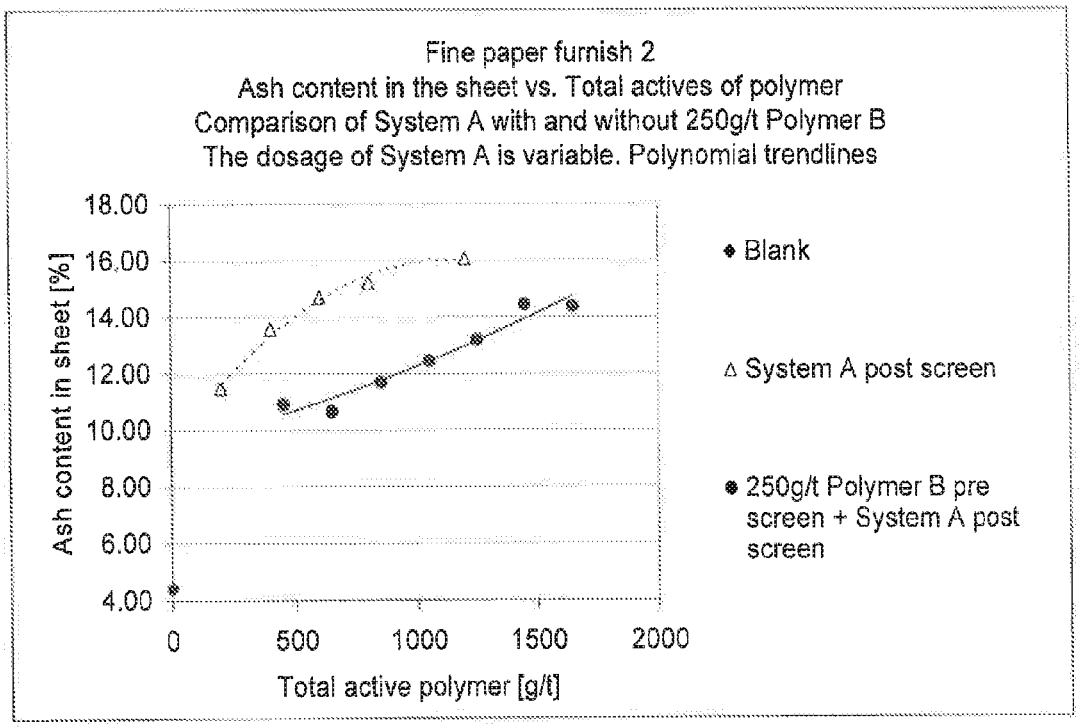
Figure 3A: Fine paper furnish 3 with system C, drainage vs. ash
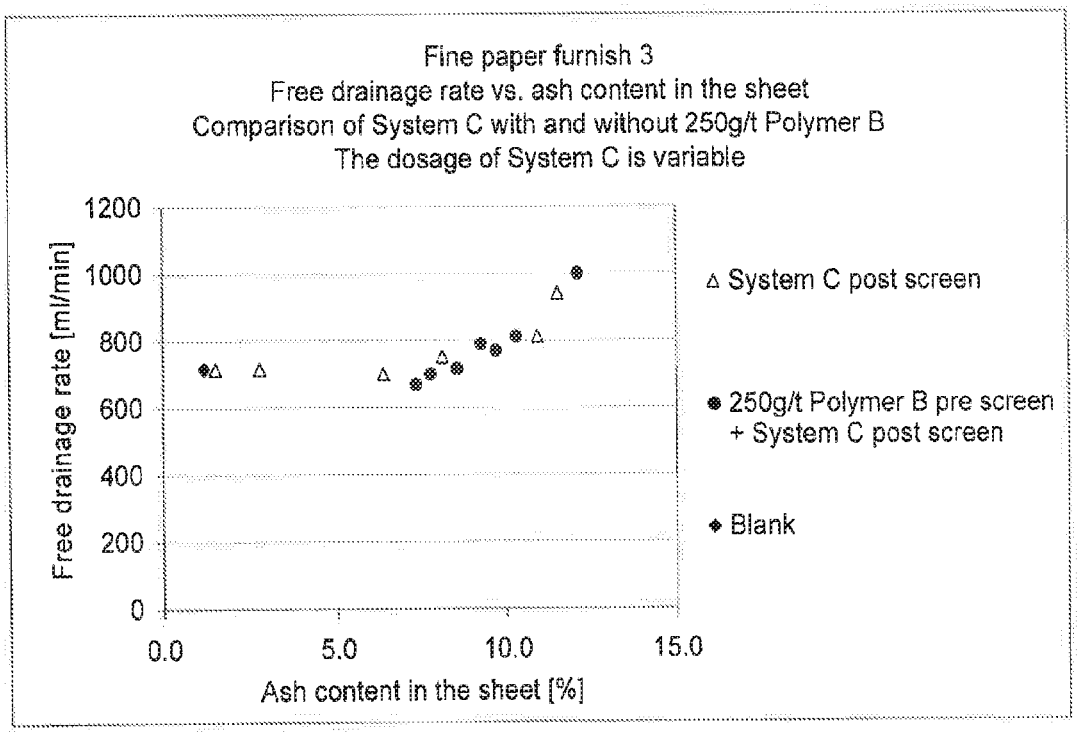

Figure 3B: Fine paper furnish 3 with system D, drainage vs. ash
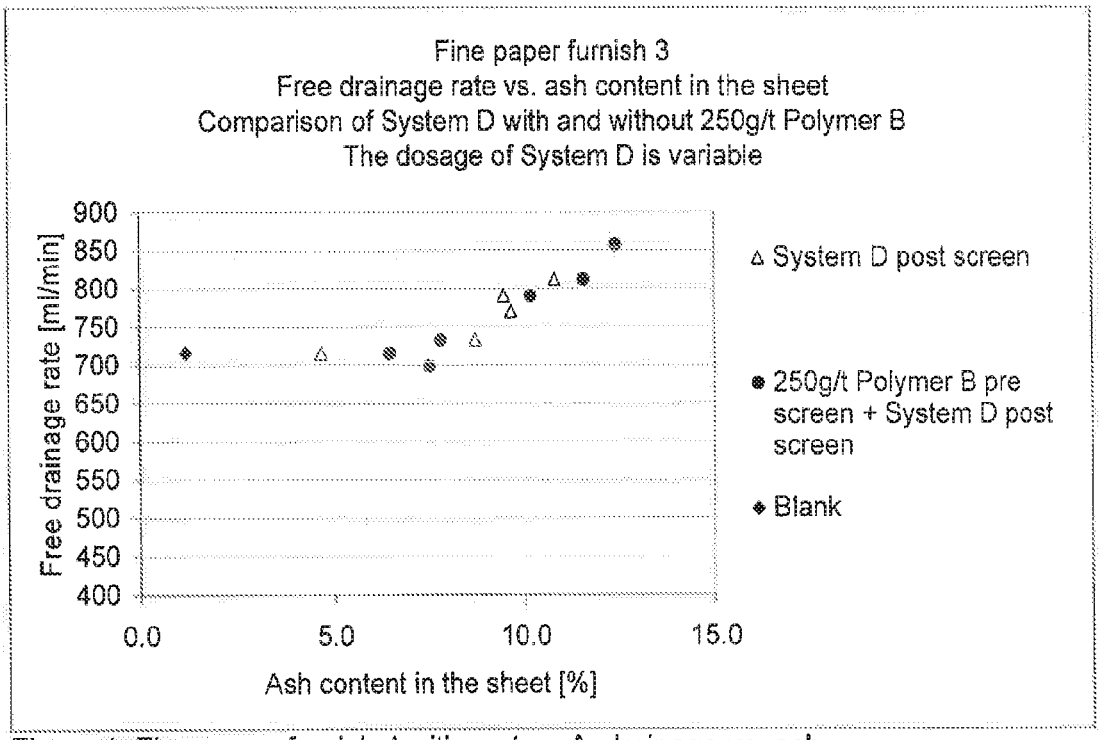
Figure 4: Fine paper furnish 4 with system A, drainage vs. ash
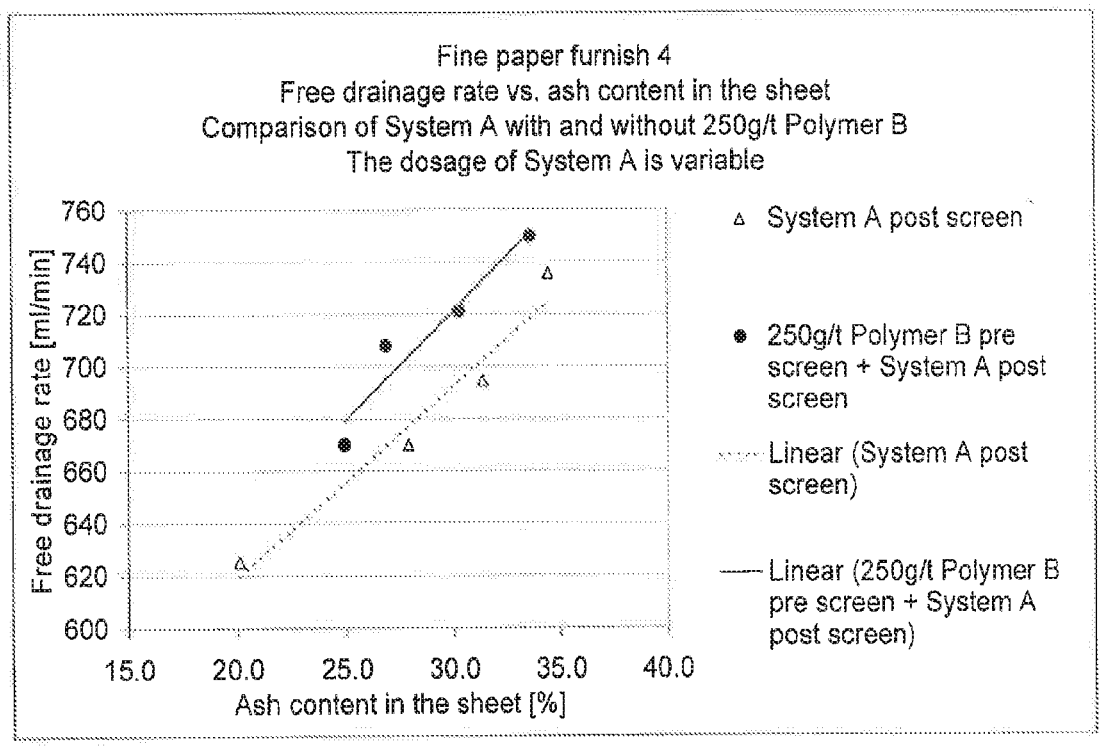

Figure 5A: Deinked recycled pulp with system A, drainage vs. ash
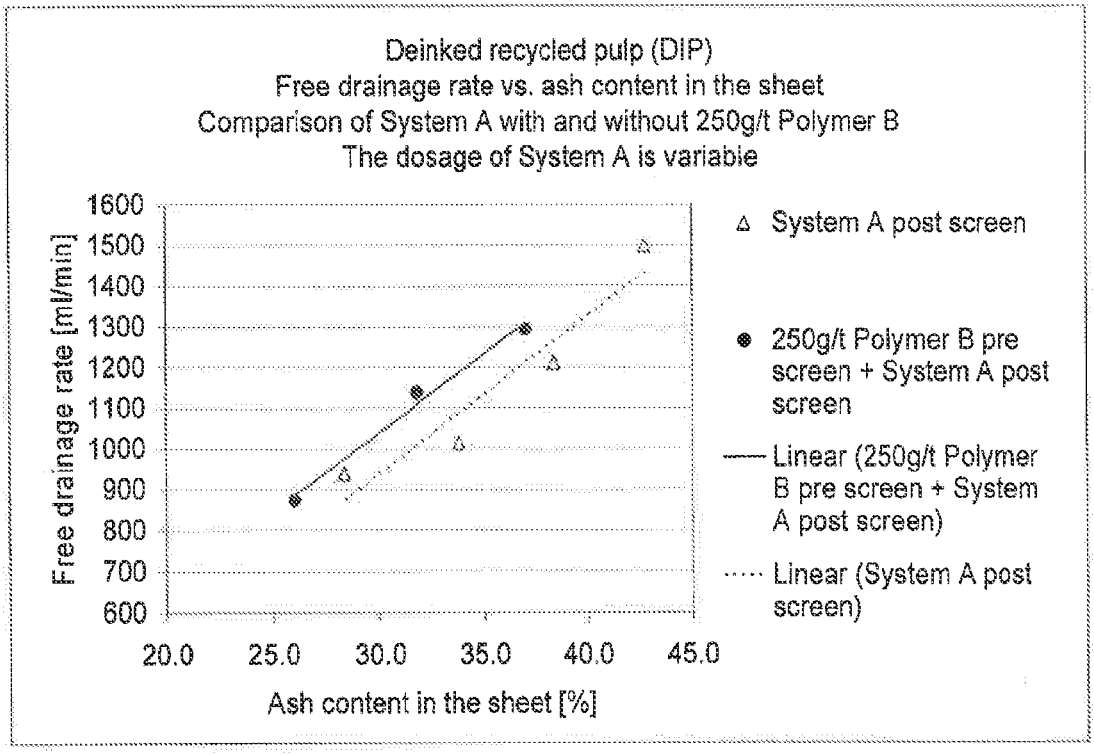
Figure 5B: Deinked recycled pulp with system B, drainage vs. ash
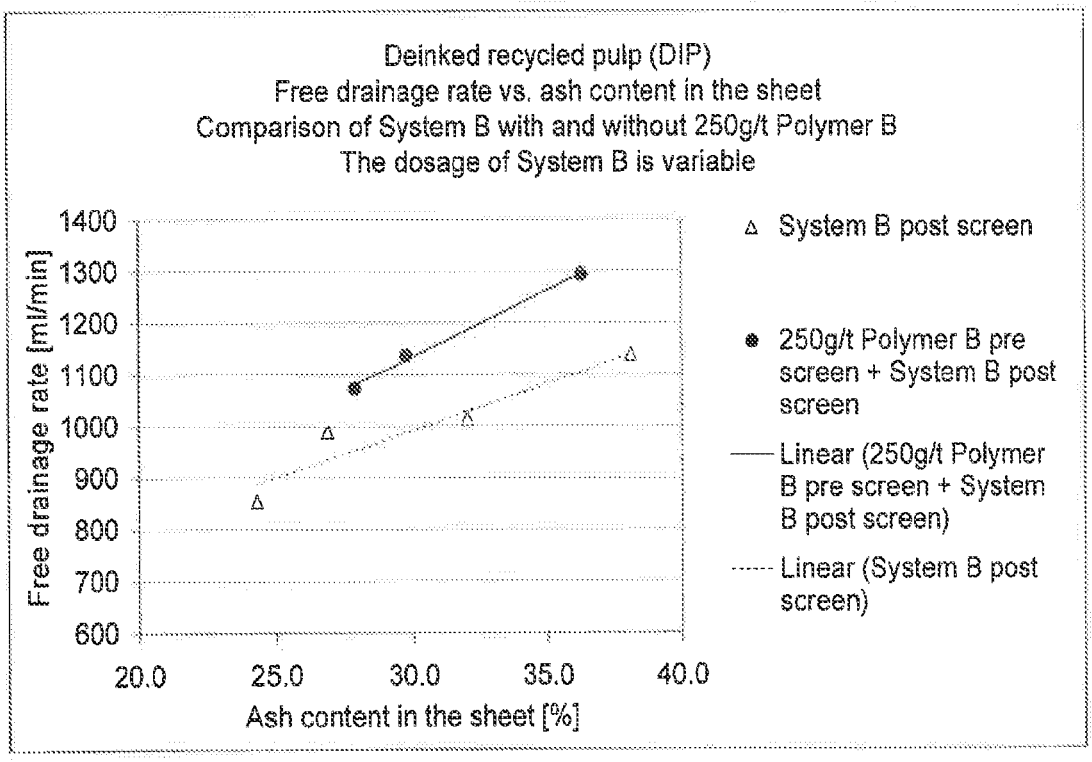

Figure 6: Mechanical furnish 1 with system E, drainage vs. ash
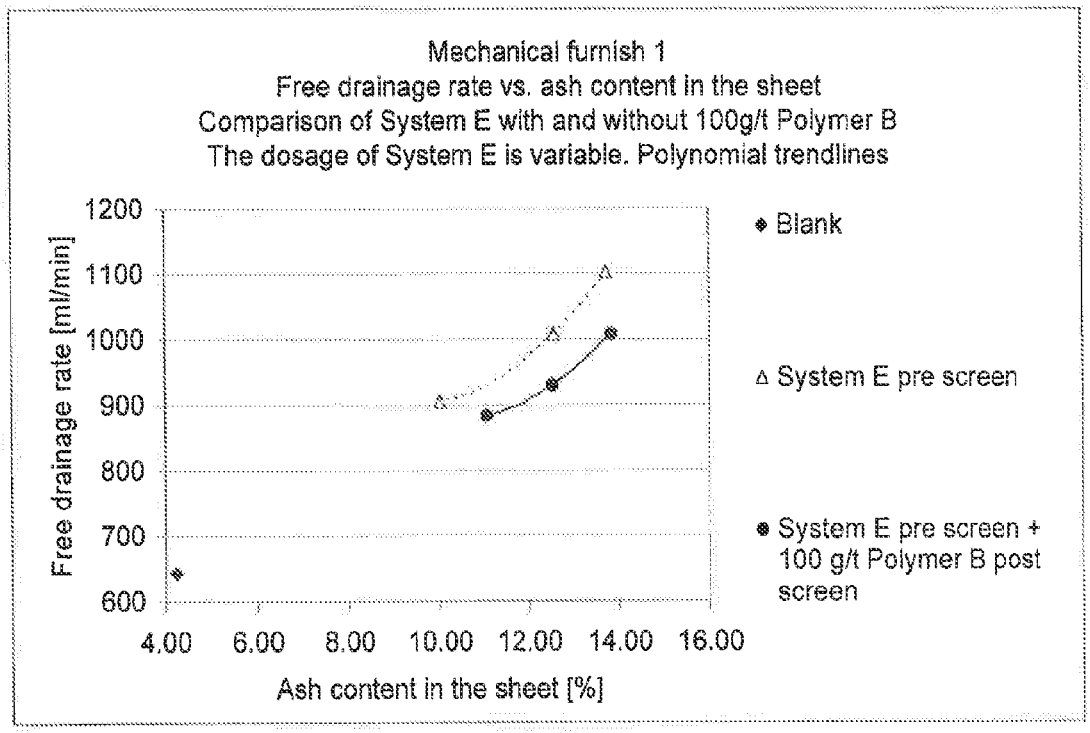
Figure 7A: Mechanical furnish 2 with system A, drainage vs. ash
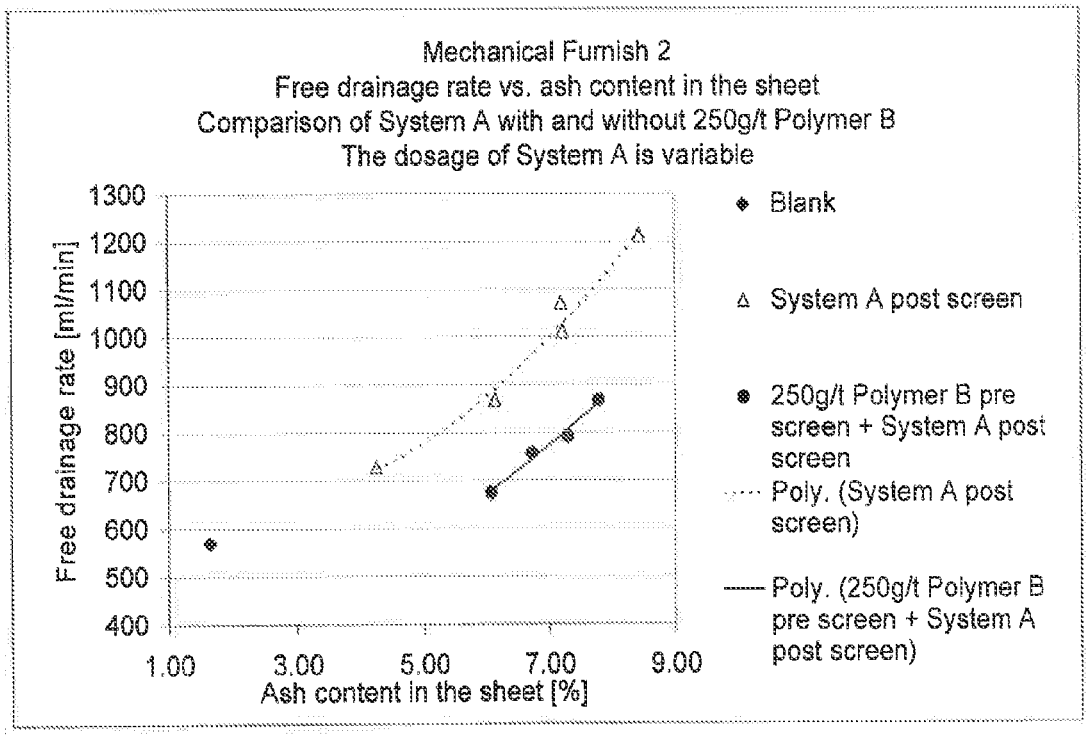

Figure 7B: Mechanical furnish 2 with system B, drainage vs. ash
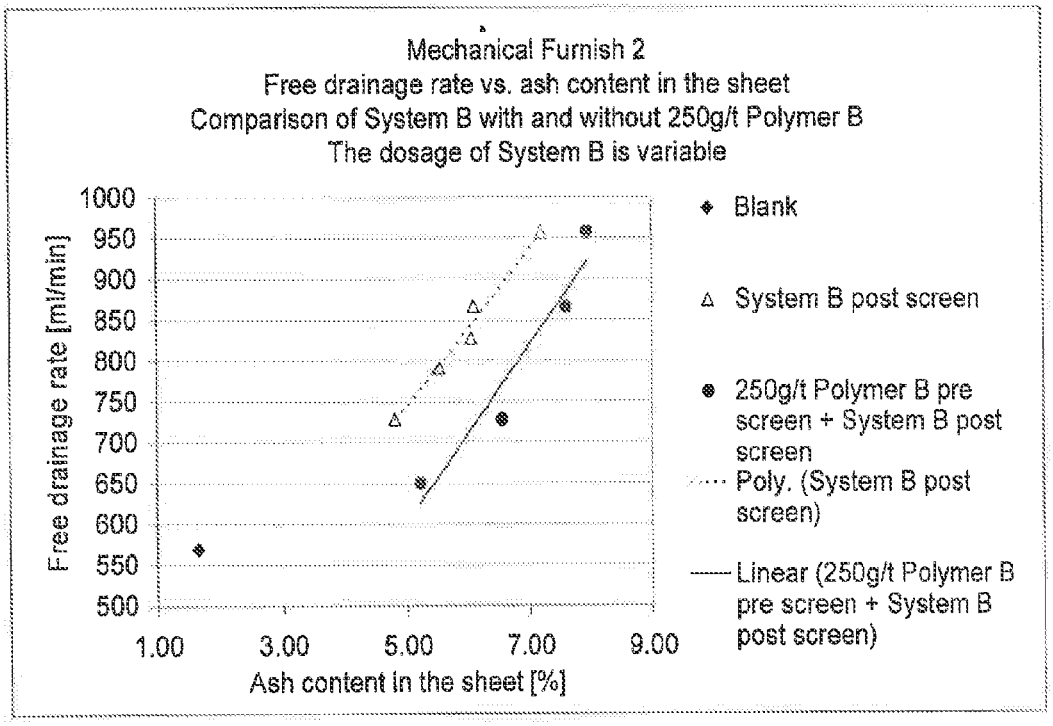
Figure 8A: Mechanical furnish 3 with system A and E, drainage vs. ash
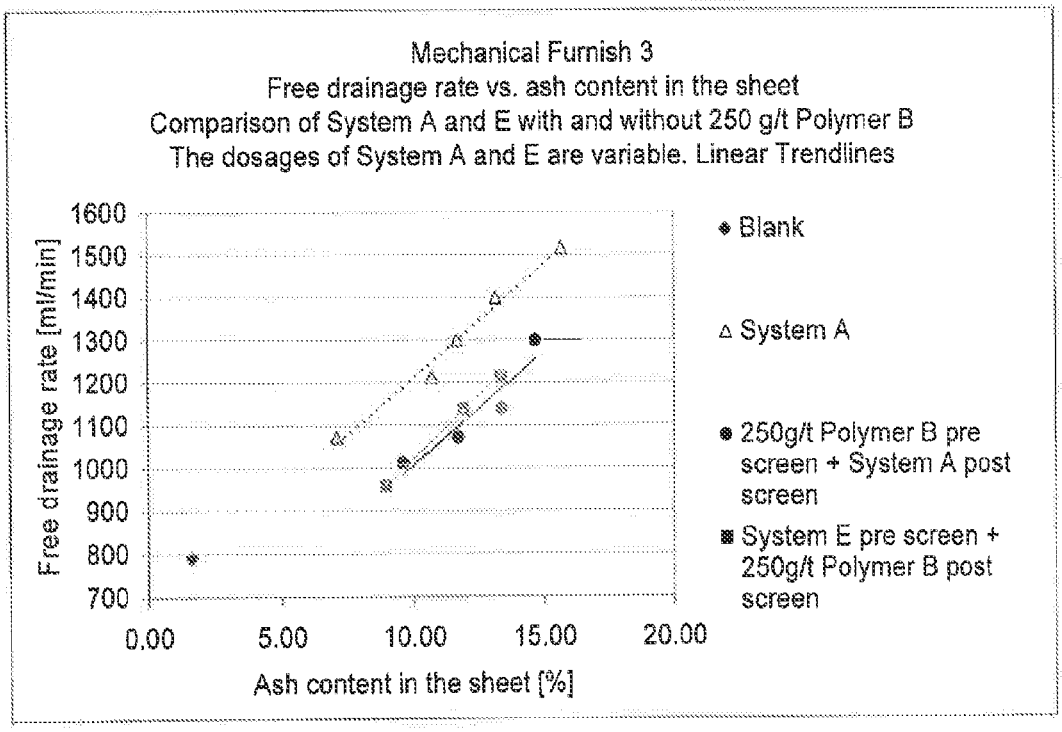

Figure 8B: Mechanical furnish 3 with system B, drainage vs. ash
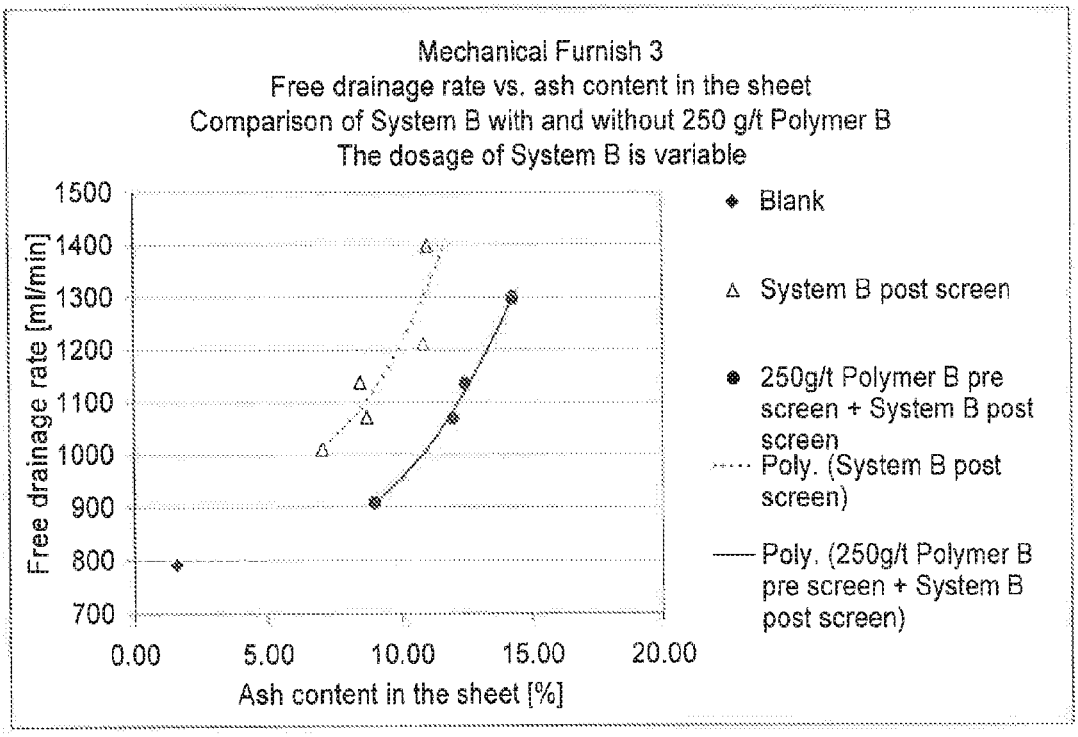
Figure 8C: Mechanical furnish 3 with system D and G, drainage vs. ash
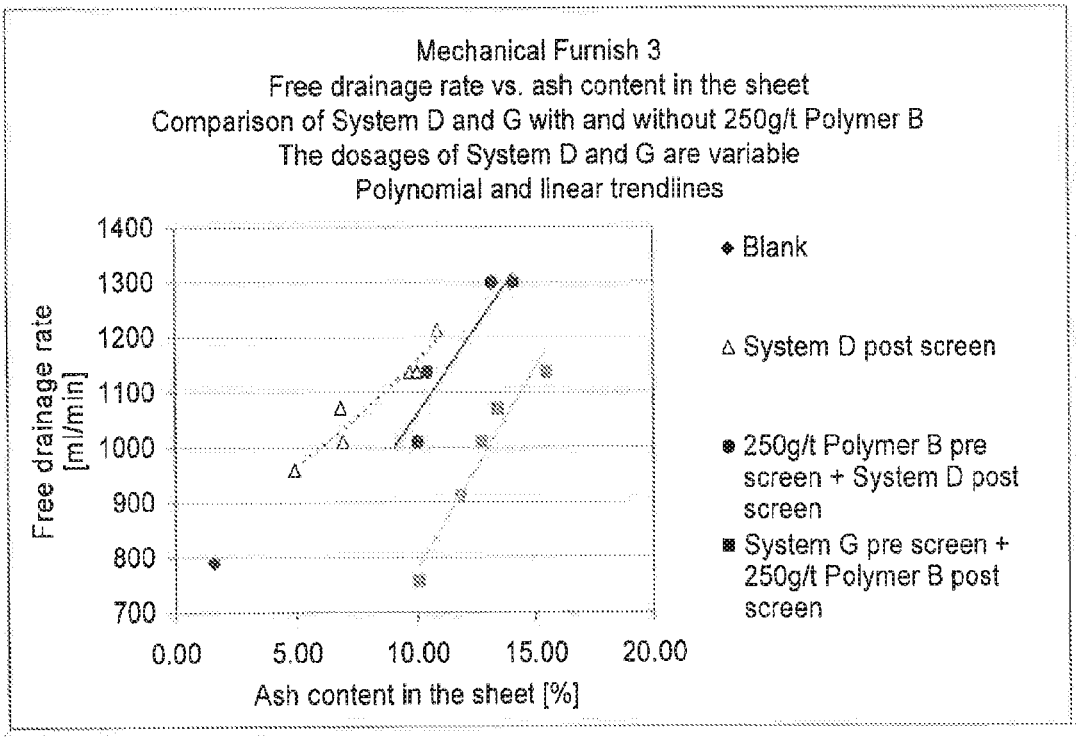

Figure 9A: Mechanical furnish 4 with system A, drainage vs. ash
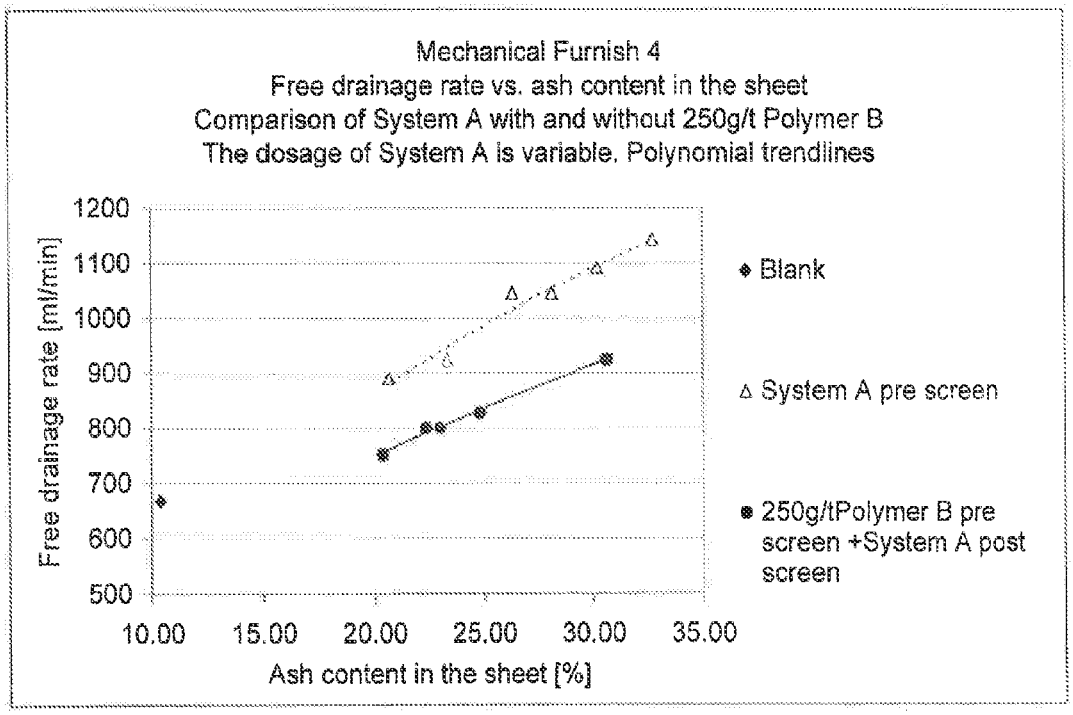
Figure 9B: Mechanical furnish 4 with system B, drainage vs. ash
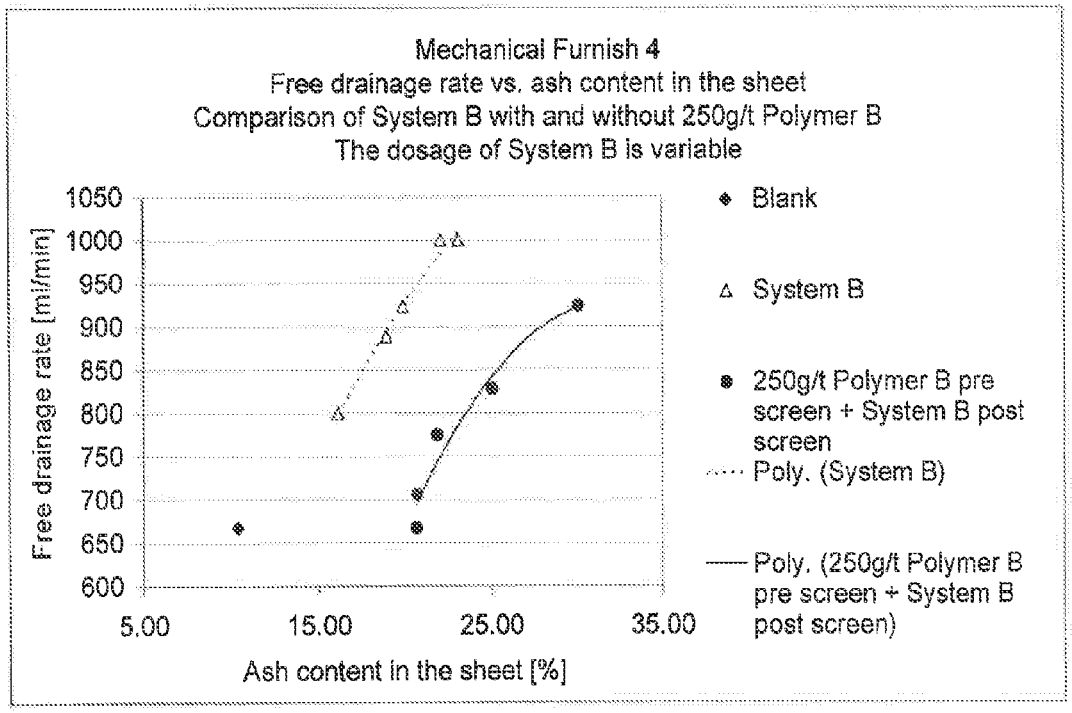

Figure 10: SC furnish 1 with system A, drainage vs. ash
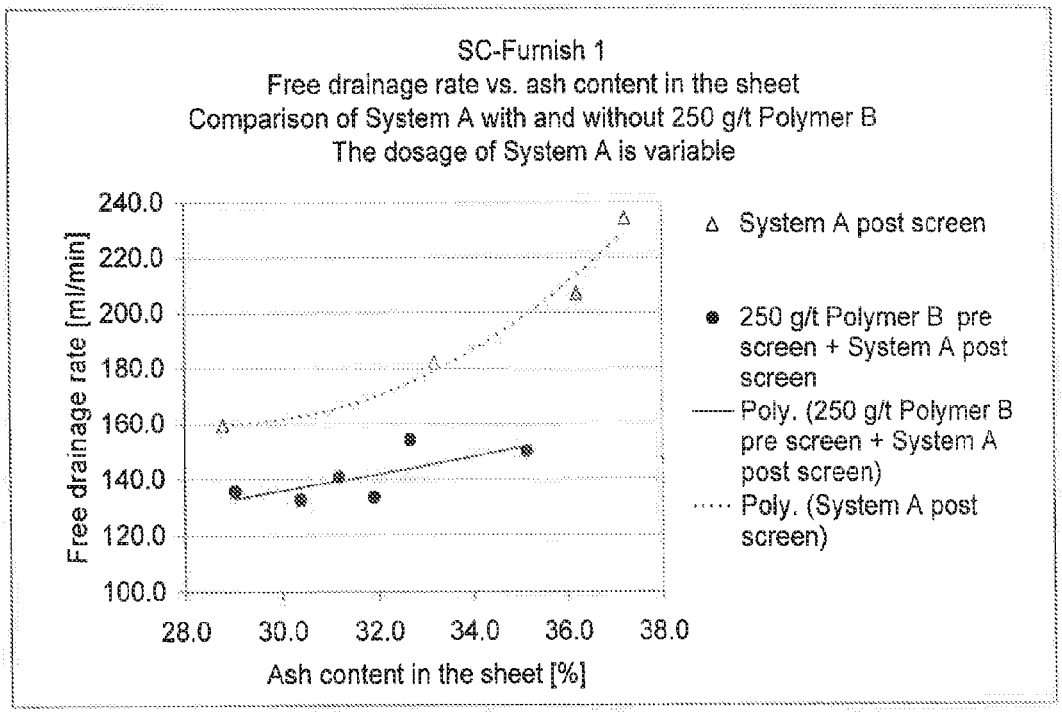
Figure 11: SC furnish 1 with system B, drainage vs. ash
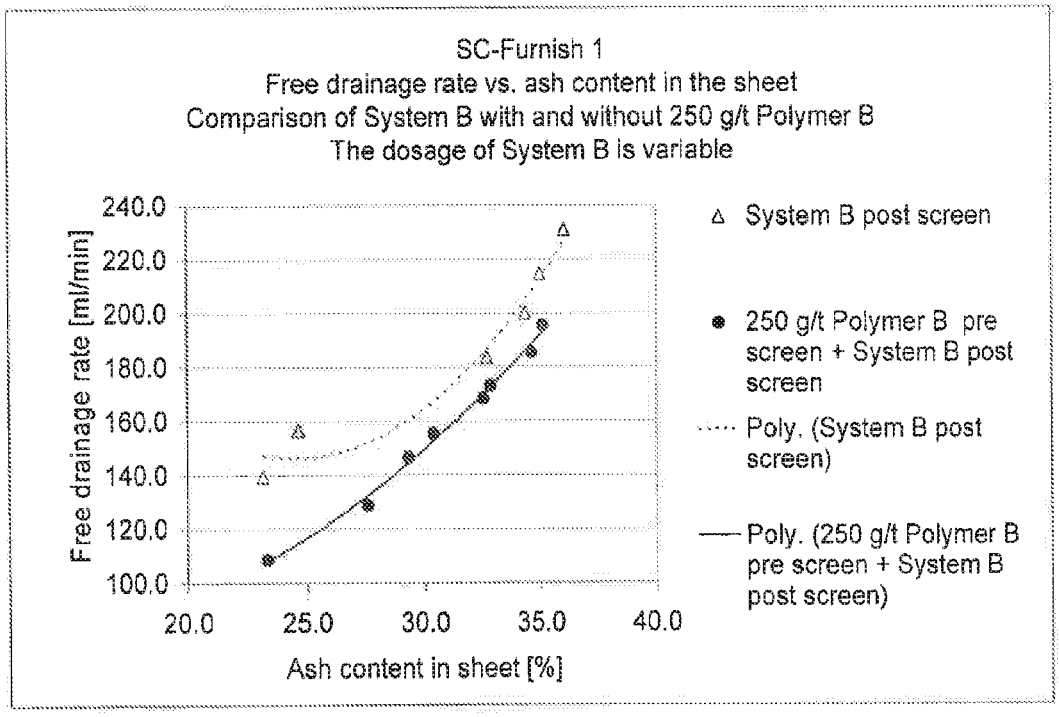

Figure 12: SC furnish 1 with system C, drainage vs. ash
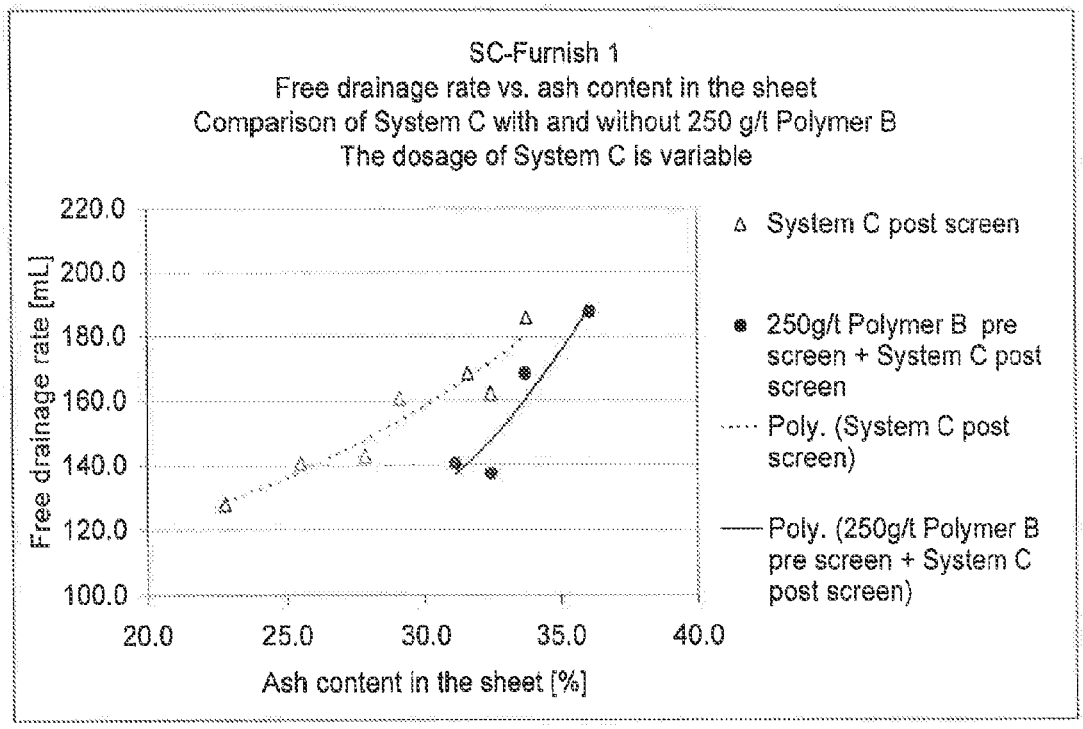
Figure 13: SC furnish 1 with system D, drainage vs. ash
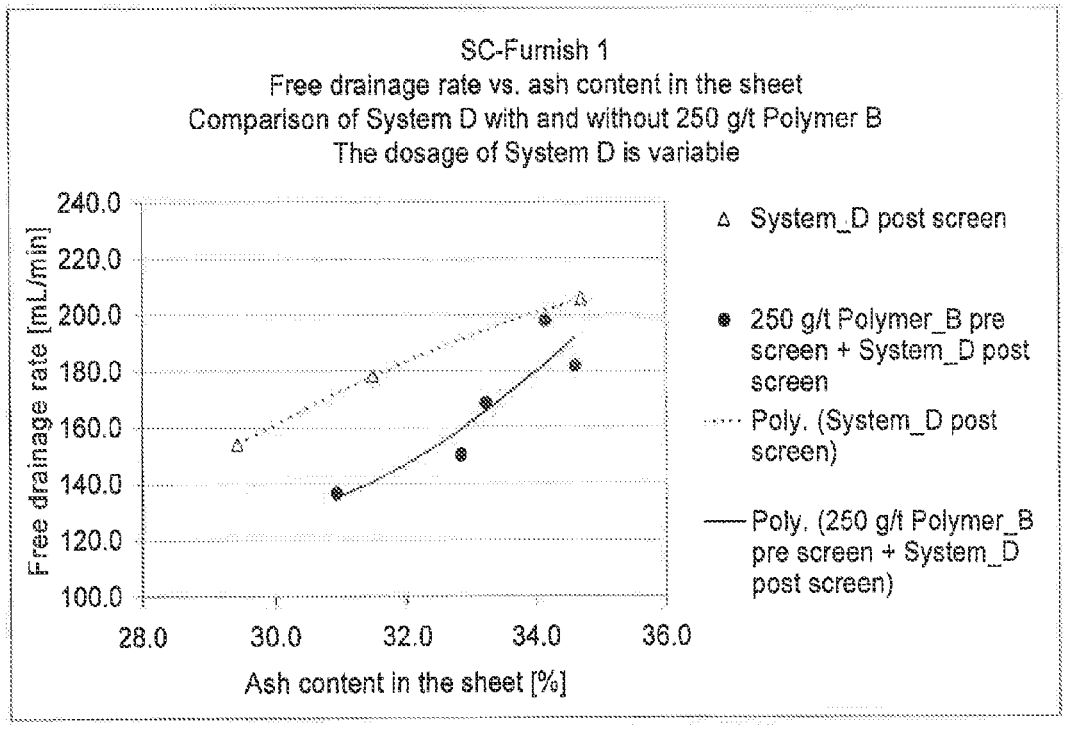

Figure 14: SC furnish 2 with system B, drainage vs. ash
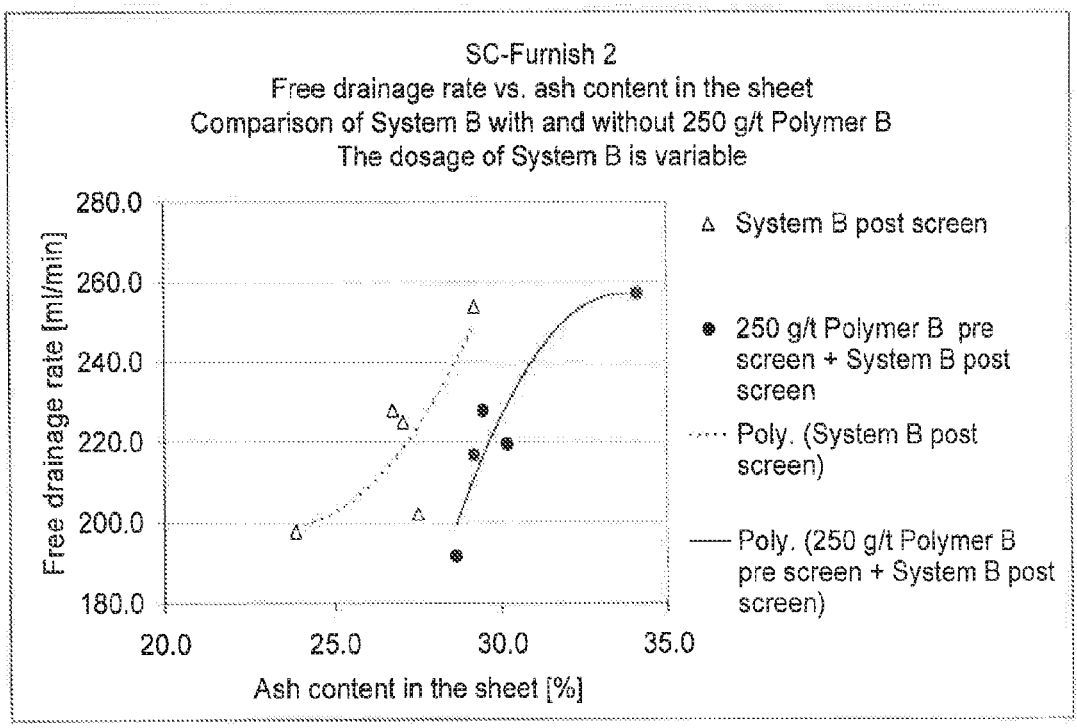
Figure 15: SC furnish 1 with system E, drainage vs. ash
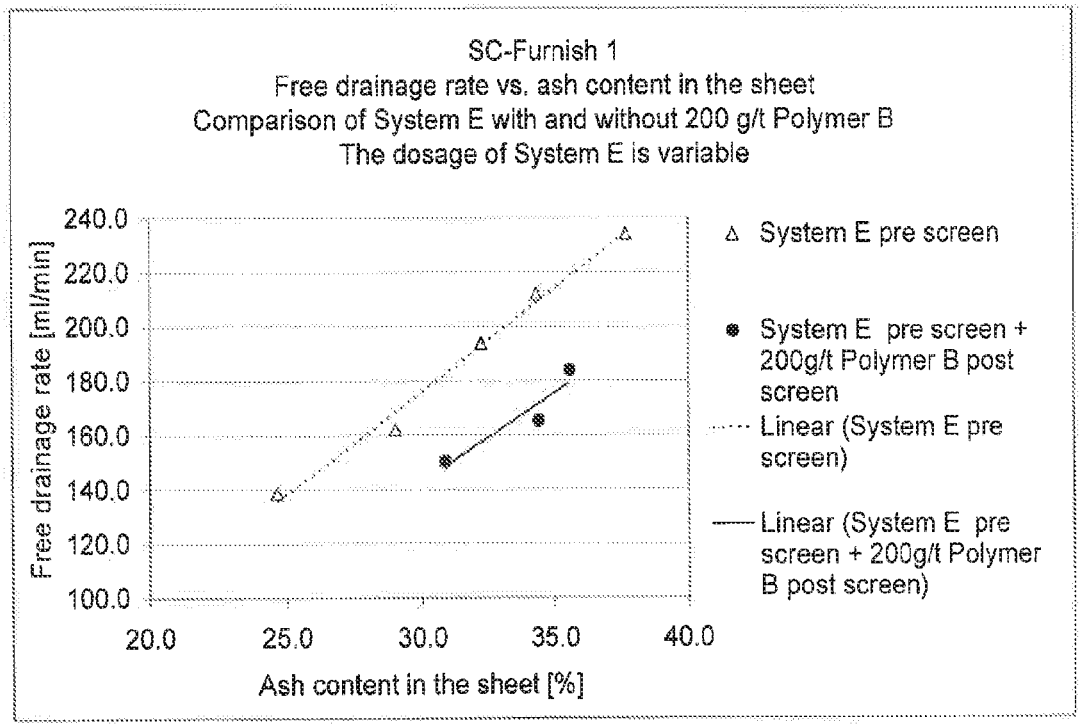

MANUFACTURE OF FILLED PAPER

This application is the National Stage of International Application No. PCT/EP2008/050648, filed Jan. 21, 2008, which claims priority to GB 0702248.6, filed Feb. 5, 2007.

This application is a 371 of PCT/EP08/50648 filed 21 Jan. 2008.

BACKGROUND

The present invention concerns a process for the manufacture of filled paper from a furnish containing mechanical pulp. In particular the invention includes processes for making highly filled mechanical paper grades, such as super calendared paper (SC-paper) or coated rotogravure (e.g. LWC).

It is well known to manufacture paper by a process that comprises flocculating a cellulosic thin stock by the addition of polymeric retention aid and then draining the flocculated suspension through a moving screen (often referred to as a machine wire) and then a forming a wet sheet, which is then dried. Some polymers tend to generate rather coarse flocs and although retention and drainage may be good unfortunately the formation and the rate of drying the resulting sheet can be impaired. It is often difficult to obtain the optimum balance between retention, drainage, drying and formation by adding a single polymeric retention aid and it is therefore common practise to add two separate materials in sequence or in some cases simultaneously.

Filled mechanical grade paper such as SC paper or coated rotogravure paper is often made using a soluble dual polymer retention system. This employs the use of two water-soluble polymers that are blended together as aqueous solutions before their addition to the thin stock. In general one of the polymers would have a higher molecular weight than the other. Both polymers would usually be linear and as water-soluble as reasonably possible. Usually the low molecular weight polymeric component would have a high cationic charge density, such as polyamine, polyethyleneimine or polyDADMAC (polymers of diallyl dimethyl ammonium chloride) coagulants. In contrast to the lower molecular weight polymers, the higher molecular weight polymeric component tends to have a relatively low cationic charge density. Typically such higher molecular weight polymers can be cationic polymers based on acrylamide or for instance polyvinyl amines. The blend of cationic polymers is commonly referred to as a cat/cat retention system.

In the general field of manufacturing paper and paperboard it is known to use other retention systems. Microparticulate retention systems employing siliceous material had been found to be very effective in improving retention and drainage. EP-A-235,893 describes a process in which a substantially linear cationic polymer is applied to the paper making stock prior to a shear stage in order to bring about flocculation, passing the flocculated stock through at least one shear stage and then reflocculating by introducing bentonite. In addition to wholly linear cationic polymers slightly cross-linked, for example branched polymers as described in EP-A-202780 may also be used. This process has been successfully commercialised by Ciba Specialty Chemicals under the trademark Hydrocol since it provides enhanced retention, drainage and formation.

Examples of other micro particulate systems used in papermaking industry are described in EP-A-0041056 and U.S. Pat. No. 4,385,961 for colloidal silica and in WO-A-9405596 and WO-A-9523021 with regard to silica based sols used in combination with cationic acrylamide polymers. U.S. Pat. No. 6,358,364, U.S. Pat. No. 6,361,652 and U.S. Pat. No. 6,361,653 each describe the use of borosilicates in conjunction with high molecular weight flocculants and/or starch in this sense.

In addition to inorganic insoluble microparticulate material organic polymeric microparticulate material is also known for papermaking processes.

U.S. Pat. No. 5,167,766 and U.S. Pat. No. 5,274,055 discuss papermaking processes with improved drainage and retention by using ionic, organic microparticles or microbeads having an average diameter of less than 750 nm if cross-linked and less than 60 nm if not cross-linked. The microparticles or microbeads are used in combination with high molecular weight ionic organic polymer and/or polysaccharide. The process may occasionally include alum.

US 2003 0192664 discloses a method for making paper by using vinyl amine polymers with ionic, organic, cross-linked polymeric microbeads. Optimisation of molecular weight, structure and the charge provide systems with improved drainage rate. The addition of different coagulants, such as polyethylene imine, alum or polyamine is said to further increase the drainage rate of these systems employing polymeric microbeads.

WO-A-9829604 describes a process of making paper by addition of a cationic polymeric retention aid to a cellulosic suspension to form flocs, mechanically degrading the flocs and then reflocculating the suspension by adding a solution of a water-soluble anionic polymer as second polymeric retention aid. The anionic polymeric retention aid is a branched polymer having a rheological oscillation of tan delta at 0.005 Hz of above 0.7 and/or having a deionised SLV viscosity number at least three times the salted SLV viscosity number of the corresponding polymer made in the absence of branching agent. The process provides significant improvements in retention, drainage and formation by comparison to the earlier prior art processes. It is emphasised on page 8 that the amount of branching agent should not be too high as the desired improvements in both dewatering and retention values will not be achieved.

U.S. Pat. No. 6,616,806 reveals a three component process of making paper by adding a substantially water-soluble polymer selected from a polysaccharide or a synthetic polymer of intrinsic viscosity at least 4 dl/g and then reflocculating by a subsequent addition of a reflocculating system. The reflocculating system comprises siliceous material and a substantially water-soluble polymer. The water-soluble polymer added before the reflocculating system is a water-soluble branched polymer that has an intrinsic viscosity above 4 dl/g and exhibits a rheological oscillation value of tan delta at 0.005 Hz of above 0.7. Drainage is increased without any significant impairment of formation in comparison to other known prior art processes.

U.S. Pat. No. 6,395,134 describes a process of making paper using a three component system in which cellulosic suspension is flocculated using a water-soluble cationic polymer, a siliceous material and an anionic branched water-soluble polymer formed from ethylenically unsaturated monomers having an intrinsic viscosity above 4 dl/g and exhibiting a rheological oscillation value of tan delta at 0.005 Hz of above 0.7. The process provides faster drainage and better formation than branched anionic polymer in the absence of colloidal silica. U.S. Pat. No. 6,391,156 describes an analogous process in which specifically bentonite is used as a siliceous material. This process also provides faster drainage and better formation than processes in which cationic polymer and branched anionic polymer are used in the absence of bentonite.

U.S. Pat. No. 6,451,902 discloses a process for making paper by applying a water-soluble synthetic cationic polymer to a cellulosic suspension specifically in the thin stock stream in order to flocculate it followed by mechanical degradation. After the centriscreen a water-soluble anionic polymer and a siliceous material are added in order to reflocculate the cellulosic suspension. Suitably the water-soluble anionic polymer can be a linear polymer. The process significantly increases drainage rate a comparison to cationic polymer and bentonite in the absence of the anionic polymer.

The prior art processes provide improvements in retention and drainage and often seek to improve the balance of retention, drainage and formation.

Nevertheless retention and drainage are increased simultaneously. None of the aforementioned prior art contemplates processes in which retention, in particular ash retention, is increased but drainage is maintained or reduced. Traditional papermaking processes have always placed emphasis on increasing retention and drainage in order to achieve higher productivity on paper machines as well as improving formation at the same time.

However, the introduction of paper machines that have extremely fast draining twin wire forming sections, frequently called Gapformers, have dramatically improved sheet building and paper stock drainage by mechanical means. Gapformer type paper machines are nowadays frequently used for the production of rotogravure printing papers, such as super calendared paper (SC) or light weight coated (LWC) papers. Gapformers drain the paper suspension fast enough so that especially for the lower basis weights between 34 and 60 g/m$^2$ further enhanced drainage rates are not required. In some cases the Gapformers provide a high level of initial drainage. If this initial drainage becomes too high this can be adverse to functioning of the essential downstream shear and drainage elements in the Gapformers. This is because a minimum concentration of fibre suspension is required to apply the drainage pulses with high shear forces to optimise formation and z-directional sheet building.

A description of a Gapformer paper machine can be found in "Duoformer CFD—a new development in the field of sheet forming systems" from Schmidt-Rohr, V.; Kohl, B. J. M. Voith GmbH, Heidenheim, Germany Wochenblatt für Papierfabrikation (1992), 120 (11-12), 455-8, 460. In this document it is stated that the initial drainage with constant pressure at the forming roll results in high retention. The subsequent drainage by pressure pulses of opposing bars in the D-section enhances formation. Therefore, with the Duoformer CFD significantly improved formation can be achieved with improved retention. In the German addition of "Together—Magazin für Papiertechnik" (Issue 6 (1998), Böck, K.-J.; Moser, J.; published by Voith Sulzer Papiertechnik GmbH & Co. KG, editor Dr. Wolfgang Möhle, Corporate Marketing, Voith Sulzer Papiertechnik GmbH) it is stated under superscription "D-section (foil or blade section)" that the sheet building in z-direction can be controlled effectively. However it is important that fibre is still in the form of a suspension in order to allow mobility of the fibres. It is further explained that due to the D-section, very good results are achieved. It is stated that by increasing the dewatering in the D-section, formation improves dramatically.

In the trade publication from the J. M. Voith GmbH ("Triple Star"—The state of the art and most efficient production line in the world for woodfree coated papers; Kotitsche, G., Merzeder, K.-D. and Tiefengruber, M. from Sappi Gratkorn GmbH; Voith trade publication p 316e, 6.98 4000, page 7, column 2, paragraph 3, FIG. 8) it is stated that "the flow rate to be drained in the foil section of the former must be as high as possible. In this way uniform and soft formation is achieved."

The aforementioned principles are still valid also for the newest generation of Gapformers. In Voith trade publication p 3276 e 4000 2002-06 "Duoformer TQv" is stated that the curved suction box and loaded forming blades, also known as the D-section, are prerequisites for excellent formation. The box has two chambers for dewatering and controlling sheet structure in z-direction. It is further stated that "in combination with the furnish quality, two main parameters influencing formation were found, regardless of the grade: the use of the forming blades and the white water flow rate in the forming shoe. A high forming shoe flow rate improves formation in any situation, whether the forming blades are loaded or not. This is caused by the effect that the forming blades work best when the suspension is liquid enough to allow fibre movements.

Another example again stresses the importance of controlled initial drainage in gapformers, e.g. designed and engineered in accordance with WO-2004018768. Metso trade publication EN_03 (December 2004) states that the BelBaie V gapformer delivers "better formation thanks to gentle initial dewatering and loadable blades (page 1). Further information can be found in "Bel Baie V upgrade" (Swietlik, Frank; Irwin, Jeff; Jaakkola, Jyrki. Metso Paper USA, Norcross, Ga., USA. Preprint—Annual Meeting, Pulp and Paper Technical Association of Canada, 90th, Montreal, QC, Canada, Jan. 27-29, 2004 (2004), Book A A109-A112. Publisher: Pulp and Paper Technical Association of Canada, Montreal, Que).

The comparable situation also applies to hybrid formers, in which the sheet is formed on a conventional Fourdrinier table, and then a top wire with dewatering elements is applied in the same manner. A general description of this hybrid former can be found in "Sheet forming with Duoformer D and pressing with shoe presses of the Flexonip type for manufacturing of linerboard and testliner, corrugating medium and folding boxboard" (Grossmann, U.; J. M. Voith GmbH, Heidenheim, Germany. Wochenblatt für Papierfabrikation (1993), 121(19), 775-6, 778, 780-2.). The control of drainage is crucial for sheet building and final product quality.

It is clear that simply increasing drainage in many cases will not provide the solution to obtaining optimised paper quality. On the contrary it would be desirable to provide controlled drainage.

Although increased dewatering in the blade section can be achieved by increasing the fan pump speed which will carry more water through into the forming zone, adjusting drainage elements, reducing headbox solids and/or reducing the initial drainage on the forming roll it would nonetheless be desirable to provide chemical means that optimise paper quality. In particular it would be desirable to provide a chemical retention system that would allow a decreased drainage rate but enhances retention. In particular it would be desirable to optimise sheet building combined with adequate ash retention in order to reach the desired filler level in addition to optimising floc size distribution. It would especially the desirable to achieve this in addition to producing finer/smaller aggregates for improved formation. Furthermore, it would be desirable to provide a process that provides increased ash retention, and preferably formation, and maintaining or preferably reducing drainage for filled mechanical grade papers.

BRIEF SUMMARY OF THE INVENTION

According to the present invention we provide a process of making filled paper comprising the steps of providing a thick stock cellulosic suspension that contains mechanical pulp and filler, diluting the thick stock suspension to form a thin stock suspension, in which the filler is present in the thin stock suspension in an amount of at least 10% by weight based on dry weight of thin stock suspension, flocculating the thick stock suspension and/or the thin stock using a polymeric retention/drainage system, draining the thin stock suspension on a screen to form a sheet and then drying the sheet, in which the polymeric retention/drainage system comprises, i) a water-soluble branched anionic polymer and ii) a water-soluble cationic or amphoteric polymer.

Unexpectedly this process brings about equal or elevated ash retention relative to total retention manifesting in an equal or elevated ash level relative to basis weight without increasing drainage. In some cases total retention is increased. Furthermore, in many cases drainage is reduced. The process also provides improvements in formation. This reduction or maintenance of free drainage enables the optimisation of sheet building, especially in the case of fast draining paper machines. In a preferred form we also find that the overall polymer dosage is reduced when making mechanical grade paper especially SC paper by comparison to prior art processes. We also find that the process enables the formation of small flocs which leads to improved formation, pore size, printability as well as good runnability in the press section of paper machine.

BRIEF DESCRIPTION OF THE DRAWINGS

FIG. 1: A plot of free drainage rate relative to the percentage of ash content in the sheet, comparing System E with and without 100 g/t Polymer B for fine paper furnish 1.

FIG. 2A: A plot of free drainage rate relative to the percentage of ash content in the sheet, comparing System A with and without 250 g/t Polymer B for fine paper furnish 2.

FIG. 2B: A plot of free drainage rate relative to the percentage of ash content in the sheet, comparing System A with and without 250 g/t Polymer B for fine paper furnish 2.

FIG. 3A: A plot of free drainage rate relative to the percentage of ash content in the sheet, comparing System C with and without 250 g/t Polymer B for fine paper furnish 3.

FIG. 3B: A plot of free drainage rate relative to the percentage of ash content in the sheet, comparing System D with and without 250 g/t Polymer B for fine paper furnish 3.

FIG. 4: A plot of free drainage rate relative to the percentage of ash content in the sheet, comparing System A with and without 250 g/t Polymer B for fine paper furnish 4.

FIG. 5A: A plot of free drainage rate relative to the percentage of ash content in the sheet, comparing System A with and without 250 g/t Polymer B for deinked recycled pulp (DIP).

FIG. 5B: A plot of free drainage rate relative to the percentage of ash content in the sheet, comparing System B with and without 250 g/t Polymer B for deinked recycled pulp (DIP).

FIG. 6: A plot of free drainage rate relative to the percentage of ash content in the sheet, comparing System E with and without 100 g/t Polymer B for mechanical furnish 1.

FIG. 7A: A plot of free drainage rate relative to the percentage of ash content in the sheet, comparing System A with and without 250 g/t Polymer B for mechanical furnish 2.

FIG. 7B: A plot of free drainage rate relative to the percentage of ash content in the sheet, comparing System B with and without 250 g/t Polymer B for mechanical furnish 2.

FIG. 8A: A plot of free drainage rate relative to the percentage of ash content in the sheet, comparing System A and E with and without 250 g/t Polymer B for mechanical furnish 3.

FIG. 8B: A plot of free drainage rate relative to the percentage of ash content in the sheet, comparing System B with and without 250 g/t Polymer B for mechanical furnish 3.

FIG. 8C: A plot of free drainage rate relative to the percentage of ash content in the sheet, comparing System D and G with and without 250 g/t Polymer B for mechanical furnish 3.

FIG. 9A: A plot of free drainage rate relative to the percentage of ash content in the sheet, comparing System A with and without 250 g/t Polymer B for mechanical furnish 4.

FIG. 9B: A plot of free drainage rate relative to the percentage of ash content in the sheet, comparing System B with and without 250 g/t Polymer B for mechanical furnish 4.

FIG. 10: A plot of free drainage rate relative to the percentage of ash content in the sheet, comparing System A with and without 250 g/t Polymer B for SC-furnish 1.

FIG. 11: A plot of free drainage rate relative to the percentage of ash content in the sheet, comparing System B with and without 250 g/t Polymer B for SC-furnish 1.

FIG. 12: A plot of free drainage rate relative to the percentage of ash content in the sheet, comparing System C with and without 250 g/t Polymer B for SC-furnish 1.

FIG. 13: A plot of free drainage rate relative to the percentage of ash content in the sheet, comparing System D with and without 250 g/t Polymer B for SC-furnish 1.

FIG. 14: A plot of free drainage rate relative to the percentage of ash content in the sheet, comparing System B with and without 250 g/t Polymer B for SC-furnish 2.

FIG. 15: A plot of free drainage rate relative to the percentage of ash content in the sheet, comparing System E with and without 200 g/t Polymer B for SC-furnish 1.

DETAILED DESCRIPTION

Figure 16A:
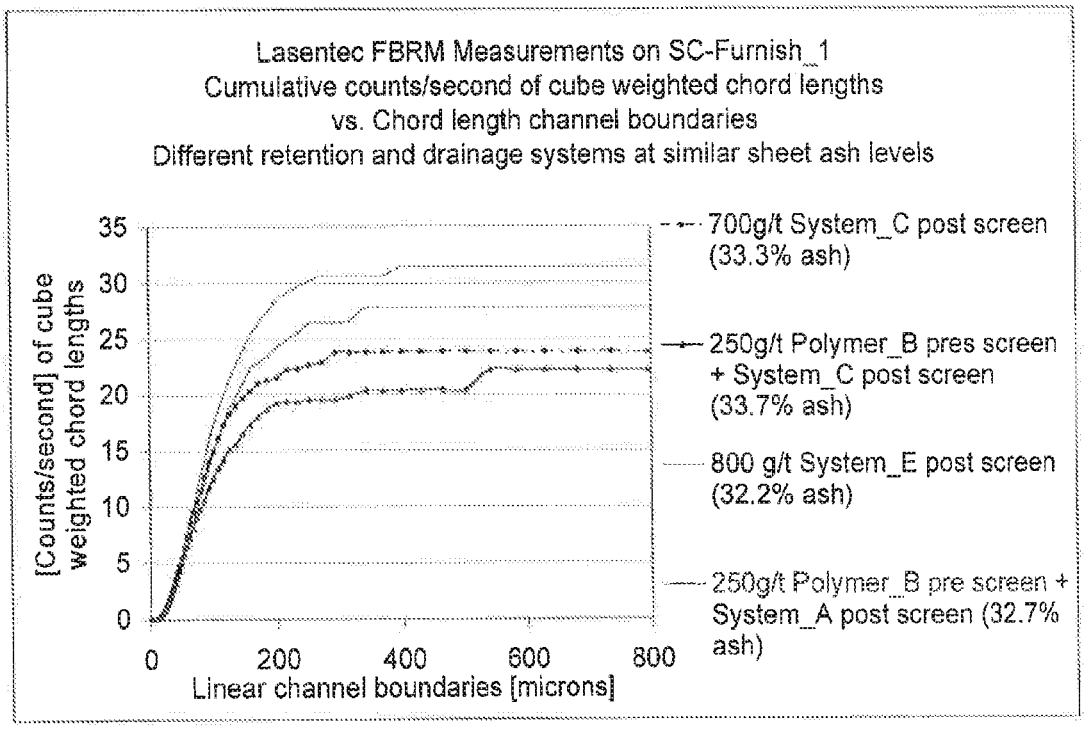
FIG. 16A: A plot of cumulative counts per second of cube weighted chord lengths relative to linear channel boundaries, comparing different retention and drainage systems at similar sheet ash levels for SC-furnish 1.

Such an improvement could not have been predicted from the aforementioned prior art, for instance WO-A-9829604, which employs cationic polymer and branched anionic polymer resulting in increase in both drainage and retention. Without being limited to theory we believe that in the present invention the anionic branched polymer and/or cationic polymer somehow interact with the cellulosic suspension containing mechanical fibre and at least 10% by weight filler resulting in a separation of the drainage rate from the degree of retention or in particular ash retention. This separation of drainage and total retention or ash retention may be referred to as a decoupling effect.

This decoupling of drainage and ash retention is particularly useful for making filled mechanical grade papers such as rotogravure printing papers, for instance super calendar paper (SC-paper) and light weight coated (LWC) papers.

In making highly filled paper the present process provides a means for incorporating preferentially more filler into the paper sheet. Thus in the preferred form of this invention where ash retention is increased relative to total retention, the relative level of fibre retention will tend to be reduced. This has the benefit of allowing paper sheets to contain a higher level of filler and a reduced level of fibre. This brings about significant commercial advantages since fibre is more expensive than the filler.

Preferably the water-soluble cationic or amphoteric polymer is a natural polymer or a synthetic polymer that has an intrinsic viscosity of at least 1.5 dl/g. Suitable natural polymers include polysaccharides that carry a cationic charge usually by post modification or alternatively are amphoteric by virtue that they carry both cationic and anionic charges. Typical natural polymers include cationic starch, amphoteric starch, chitin, chitosan etc. Preferably the cationic or amphoteric polymer is synthetic. More preferably the synthetic polymer is formed from ethylenically unsaturated cationic monomer or blend of monomers including at least one cationic monomer and if amphoteric at least one cationic monomer and at least one anionic monomer. When the polymer is amphoteric it is preferred that it carries more cationic groups than anionic groups such that the amphoteric polymer is predominantly cationic. In general cationic polymers are preferred. Particularly preferred cationic or amphoteric polymers have an intrinsic viscosity of at least 3 dl/g. Typically the intrinsic viscosity will be at least 4 dl/g, and often it can be as high as 20 or 30 dl/g but preferably will be between 4 and 10 d/g.

Intrinsic viscosity of polymers may be determined by preparing an aqueous solution of the polymer (0.5-1% w/w) based on the active content of the polymer. 2 g of this 0.5-1% polymer solution is diluted to 100 ml in a volumetric flask with 50 ml of 2M sodium chloride solution that is buffered to pH 7.0 (using 1.56 g sodium dihydrogen phosphate and 32.26 g disodium hydrogen phosphate per liter of deionised water) and the whole is diluted to the 100 ml mark with deionised water. The intrinsic viscosity of the polymers is measured using a Number 1 suspended level viscometer at 25° C. in 1M buffered salt solution. Intrinsic viscosity values stated are determined according to this method unless otherwise stated.

The polymer may be prepared by polymerisation of a water soluble monomer or water soluble monomer blend. By water soluble we mean that the water soluble monomer or water soluble monomer blend has a solubility in water of at least 5 g in 100 ml of water and 25° C. The polymer may be prepared conveniently by any suitable polymerisation process.

Preferably the water soluble polymer is cationic and is formed from one or more ethylenically unsaturated cationic monomers optionally with one or more of the nonionic monomers referred to herein. The cationic monomers include dialkylamino alkyl (meth) acrylates, dialkylamino alkyl (meth) acrylamides, including acid addition and quaternary ammonium salts thereof, diallyl dimethyl ammonium chloride. Preferred cationic monomers include the methyl chloride quaternary ammonium salts of dimethylamino ethyl acrylate and dimethyl aminoethyl methacrylate. Suitable non-ionic monomers include unsaturated nonionic monomers, for instance acrylamide, methacrylamide, hydroxyethyl acrylate, N-vinylpyrrolidone. A particularly preferred polymer includes the copolymer of acrylamide with the methyl chloride quaternary ammonium salts of dimethylamino ethyl acrylate.

When the polymer is amphoteric it may prepared from at least one cationic monomer and at least one anionic monomer and optionally at least one non-ionic monomer. The cationic monomers and optionally non-ionic monomers are stated above in regard to cationic polymers. Suitable anionic monomers include acrylic acid, methacrylic acid, maleic acid, crotonic acid, itaconic acid, vinylsulphonic acid, allyl sulphonic acid, 2-acrylamido-2-methylpropane sulphonic acid and salts thereof.

The polymers may be linear in that they have been prepared substantially in the absence of branching or cross-linking agent. Alternatively the polymers can be branched or cross-linked, for example as in EP-A-202780.

Desirably the polymer may be prepared by reverse phase emulsion polymerisation, optionally followed by dehydration under reduced pressure and temperature and often referred to as azeotropic dehydration to form a dispersion of polymer particles in oil. Alternatively the polymer may be provided in the form of beads by reverse phase suspension polymerisation, or as a powder by aqueous solution polymerisation followed by comminution, drying and then grinding. The polymers may be produced as beads by suspension polymerisation or as a water-in-oil emulsion or dispersion by water-in-oil emulsion polymerisation, for example according to a process defined by EP-A-150933, EP-A-102760 or EP-A-126528.

It is particularly preferred that the polymer is cationic and is formed from at least 10% by weight cationic monomer or monomers. Even more preferred are polymers comprising at least 20 or 30% by weight cationic monomer units. It may be desirable to employ cationic polymers having very high cationicities, for instance greater than 50% up to 80 or even 100% cationic monomer units. It is especially preferred when the cationic second flocculant polymer is selected from the group consisting of cationic polyacrylamides, polymers of dialkyl diallyl ammonium chloride for example diallyl dimethyl ammonium chloride, dialkyl amino alkyl (meth)-acrylates (or salts thereof) and dialkyl amino alkyl (meth)-acrylamides (or salts thereof). Other suitable polymers include polyvinyl amines and Manich modified polyacrylamides. Particularly preferred polymers include between 20 and 60% by weight dimethyl amino ethyl acrylate and/or methacrylate and between 40 and 80% by weight acrylamide.

The dose of water-soluble cationic or amphoteric polymer should be an effective amount and will normally be at least 20 g and usually at least 50 g per tonne of dry cellulosic suspension. The dose can be as high as one or two kilograms per tonne but will usually be within the range of 100 or 150 g per tonne up to 800 g per tonne. Usually more effective results are achieved when the dose of water-soluble cationic or amphoteric polymer is at least 200 g per tonne, typically at least 250 g per tonne and frequently at least 300 g per tonne.

The cationic or amphoteric polymer may be added into the thick stock or into the thin stock stream. Preferably the cationic or amphoteric polymer is added into the thin stock stream, for instance prior to one or the mechanical degradation stages, such as fan pump or centriscreen. Preferably the polymer is added after at least one of the mechanical degradation stages.

Particularly effective results are found when the water-soluble cationic or amphoteric polymer is used in conjunction with a cationic coagulant. The cationic coagulant may be an inorganic material such as alum, polyaluminium chloride, aluminium chloride trihydrate and aluminochloro hydrate. However, it is preferred that the cationic coagulant is an organic polymer.

The cationic coagulant is desirably a water soluble polymer which may for instance be a relatively low molecular weight polymer of relatively high cationicity. For instance the polymer may be a homopolymer of any suitable ethylenically unsaturated cationic monomer polymerised to provide a polymer with an intrinsic viscosity of up to 3 d/g. Typically the intrinsic viscosity will usually the at least 0.1 dl/g and frequently within the range of 0.2 or 0.5 dl/g to 1 or 2 dl/g. Homopolymers of diallyl dimethyl ammonium chloride (DADMAC) are preferred. Other cationic coagulants of value include polyethylene imine, polyamine epichlorohydrin and polydicyandiamide.

The low molecular weight high cationicity polymer may for instance be an addition polymer formed by condensation of amines with other suitable di- or tri-functional species. For instance the polymer may be formed by reacting one or more amines selected from dimethyl amine, trimethyl amine and ethylene diamine etc and epihalohydrin, epichlorohydrin being preferred. Other suitable cationic coagulant polymers include low molecular weight high charge density polyvinyl amines. Polyvinyl amines can be prepared by polymerisation vinyl acetamide to form polyvinyl acetamide followed by hydrolysis the resulting in polyvinyl amines. In general the cationic coagulants exhibit a cationic charge density of at least 2 and usually at least 3 mEq/g and may be as high as 4 or 5 mEq/g or higher.

It is particularly preferred that the cationic coagulant is a synthetic polymer of intrinsic viscosity at least 1 or 2 dl/g often up to 3 dl/g or even higher and exhibiting a cationic charge density of greater than 3 meq/g, preferably a homopolymer of DADMAC. PolyDADMACs can be prepared by polymerising an aqueous solution of DADMAC monomer using redox initiators to provide an aqueous solution of polymer. Alternatively an aqueous solution of DADMAC monomer can be suspended in a water immiscible liquid using suspending agents e.g. surfactants or stabilisers and polymerised to form polymeric beads of polyDADMAC.

An especially preferred cationic coagulant is a relatively high molecular weight homopolymer of DADMAC that exhibits an intrinsic viscosity of at least 2 dl/g. Such a polymer can be made by preparing an aqueous solution containing DADMAC monomer, a radical initiator or mixture are radical initiators in a or between 0.1 and 5% based on the monomer and optionally a chelating agent. Heating this monomer mixture at the temperature and below 60° C. in order to polymerise the monomer to the homopolymer having a level of conversion between 80 and 99%. Then post treating this homopolymer by heating a two-way temperature between 60 and 120° C. Typically this polymer of DADMAC can be prepared in accordance with the description given in PCT/EP 2006/067244.

An effective amount dose of cationic coagulant will typically be at least 20 g and usually at least 50 g per tonne of dry cellulosic suspension. The dose can be as high as one or two kilograms per tonne but will usually be within the range of 100 or 150 g per tonne up to 800 g per tonne. Usually more effective results are achieved when the dose of water-soluble cationic or amphoteric polymer is at least 200 g per tonne, typically at least 250 g per tonne and frequently at least 300 g per tonne.

The water-soluble cationic or amphoteric polymer and the cationic coagulant may be added sequentially or simultaneously. The cationic coagulant may be added into the thick stock or into the thin stock. In some circumstances it may be useful to add the cationic coagulant into the mixing chest or blend chest or alternatively into one or more components of the thick stock. The cationic coagulant may be added prior to the water-soluble cationic or amphoteric polymer or alternatively it may be added subsequent to the water-soluble cationic or amphoteric polymer. Preferably, however, the water-soluble cationic or amphoteric polymer and cationic coagulant are added to the cellulosic suspension as a blend. This blend may be referred to as a cat/cat retention system.

Generally the water-soluble cationic or amphoteric polymer will have a higher molecular weight (and intrinsic viscosity) than the cationic coagulant.

The amount of cat/cat blend will normally be as stated above in relation to each of the two components. In general we find that the dosage of cationic or amphoteric polymer alone or the cat/cat blend is lower in comparison to a system in which branched anionic polymer is not included.

The water-soluble branched anionic polymer may be any suitable water-soluble polymer that has at least some degree of branching or structuring, provided that the structuring is not so excessive as to render the polymer insoluble.

Preferably the water-soluble branched anionic polymer has
(a) intrinsic viscosity above 1.5 dl/g and/or saline Brookfield viscosity (UL viscosity) of above about 2.0 mPa·s and
(b) rheological oscillation value of tan delta at 0.005 Hz of above 0.7 and/or
(c) deionised SLV viscosity number which is at least three times the salted SLV viscosity number of the corresponding unbranched polymer made in the absence of branching agent.

The anionic branched polymer is formed from a water soluble monomer blend comprising at least one anionic or potentially anionic ethylenically unsaturated monomer and a small amount of branching agent for instance as described in WO-A-9829604. Generally the polymer will be formed from a blend of 5 to 100% by weight anionic water soluble monomer and 0 to 95% by weight non-ionic water soluble monomer.

Typically the water soluble monomers have a solubility in water of at least 5 g/100 $cm^3$. The anionic monomer is preferably selected from the group consisting of acrylic acid, methacrylic acid, maleic acid, crotonic acid, itaconic acid, 2-acrylamido-2-methylpropane sulphonic acid, allyl sulphonic acid and vinyl sulphonic acid and alkali metal or ammonium salts thereof. The non-ionic monomer is preferably selected from the group consisting of acrylamide, methacrylamide, N-vinyl pyrrolidone and hydroxyethyl acrylate. A particularly preferred branched polymer comprises sodium acrylate with branching agent or acrylamide, sodium acrylate and branching agent.

The branching agent can be any chemical material that causes branching by reaction through the carboxylic or other pendant groups (for instance an epoxide, silane, polyvalent metal or formaldehyde). Preferably the branching agent is a polyethylenically unsaturated monomer which is included in the monomer blend from which the polymer is formed. The amounts of branching agent required will vary according to the specific branching agent. Thus when using polyethylenically unsaturated acrylic branching agents such as methylene bis acrylamide the molar amount is usually below 30 molar ppm and preferably below 20 ppm. Generally it is below 10 ppm and most preferably below 5 ppm. The optimum amount of branching agent is preferably from around 0.5 to 3 or 3.5 molar ppm or even 3.8 ppm but in some instances it may be desired to use 7 or 10 ppm.

Preferably the branching agent is water-soluble. Typically it can be a difunctional material such as methylene bis acrylamide or it can be a trifunctional, tetrafunctional or a higher functional cross-linking agent, for instance tetra allyl ammonium chloride. Generally since allylic monomer tend to have lower reactivity ratios, they polymerise less readily and thus it is standard practice when using polyethylenically unsaturated allylic branching agents, such as tetra allyl ammonium chloride to use higher levels, for instance 5 to 30 or even 35 molar ppm or even 38 ppm and even as much as 70 or 100 ppm.

It may also be desirable to include a chain transfer agent into the monomer mix. Where chain transfer agent is included it may be used in an amount of at least 2 ppm by weight and may also be included in an amount of up to 200 ppm by weight. Typically the amounts of chain transfer agent may be in the range 10 to 50 ppm by weight. The chain transfer agent may be any suitable chemical substance, for instance sodium hypophosphite, 2-mercaptoethanol, malic acid or thioglycolic acid. Preferably, however, the anionic branched polymer is prepared in the absence of added chain transfer agent.

The anionic branched polymer is generally in the form of a water-in-oil emulsion or dispersion. Typically the polymers are made by reverse phase emulsion polymerisation in order to form a reverse phase emulsion. This product usually has a particle size at least 95% by weight below 10 μm and preferably at least 90% by weight below 2 μm, for instance substantially above 100 nm and especially substantially in the range 500 nm to 1 μm. The polymers may be prepared by conventional reverse phase emulsion or microemulsion polymerisation techniques.

The tan delta at 0.005 Hz value is obtained using a Controlled Stress Rheometer in Oscillation mode on a 1.5% by weight aqueous solution of polymer in deionised water after tumbling for two hours. In the course of this work a Carrimed CSR 100 is used fitted with a 6 cm acrylic cone, with a 1° 58' cone angle and a 58 μm truncation value (Item ref 5664). A sample volume of approximately 2-3 cc is used. Temperature is controlled at 20.0° C.±0.1° C. using the Peltier Plate. An angular displacement of $5\times10^{-4}$ radians is employed over a frequency sweep from 0.005 Hz to 1 Hz in 12 stages on a logarithmic basis. G' and G" measurements are recorded and used to calculate tan delta (G"/G') values. The value of tan delta is the ratio of the loss (viscous) modulus G" to storage (elastic) modulus G' within the system.

At low frequencies (0.005 Hz) it is believed that the rate of deformation of the sample is sufficiently slow to enable linear or branched entangled chains to disentangle. Network or cross-linked systems have permanent entanglement of the chains and show low values of tan delta across a wide range of frequencies, Therefore low frequency (e.g. 0.005 Hz) measurements are used to characterise the polymer properties in the aqueous environment.

The anionic branched polymers should have a tan delta value at 0.005 Hz of above 0.7, Preferred anionic branched polymers have a tan delta value of 0.8 at 0.005 Hz. The tan delta value can be at least 1.0 and in some cases can be as high as 1.8 or 2.0 or higher. Preferably the intrinsic viscosity is at least 2 dl/g, for instance at least 4 dl/g, in particular at least 5 or 6 dl/g. It may be desirable to provide polymers of substantially higher molecular weight, which exhibit intrinsic viscosities as high as 16 or 18 dl/g. However most preferred polymers have intrinsic viscosities in the range 7 to 12 dl/g, especially 8 to 10 dl/g.

The preferred branched anionic polymer can also be characterised by reference to the corresponding polymer made under the same polymerisation conditions but in the absence of branching agent (i.e., the "unbranched polymer"). The unbranched polymer generally has an intrinsic viscosity of at least 6 dl/g and preferably at least 8 dl/g. Often it is 16 to 30 dl/g. The amount of branching agent is usually such that the intrinsic viscosity is reduced by 10 to 70%, or sometimes up to 90%, of the original value (expressed in dl/g) for the unbranched polymer referred to above.

The saline Brookfield viscosity (UL viscosity) of the polymer is measured by preparing a 0.1% by weight aqueous solution of active polymer in 1M NaCl aqueous solution at 25° C. using a Brookfield viscometer fitted with a UL adaptor at 6 rpm. Thus, powdered polymer or a reverse phase polymer would be first dissolved in deionised water to form a concentrated solution and this concentrated solution is diluted with the 1M NaCl aqueous. The saline solution viscosity is usually above 2.0 mPa·s and is often at least 2.2 and preferably at least 2.5 mPa·s. In many cases it is not more than 5 mPa·s and values of 3 to 4 are usually preferred. These are all measured at 60 rpm.

The SLV viscosity numbers used to characterise the anionic branched polymer are determined by use of a glass suspended level viscometer at 25° C., the viscometer being chosen to be appropriate according to the viscosity of the solution. The viscosity number is $\eta-\eta_o/\eta_o$ where $\eta$ and $\eta_o$ are the viscosity results for aqueous polymer solutions and solvent blank respectively. This can also be referred to as specific viscosity. The deionised SLV viscosity number is the number obtained for a 0.05% aqueous solution of the polymer prepared in deionised water. The salted SLV viscosity number is the number obtained for a 0.05% polymer aqueous solution prepared in 1M sodium chloride.

The deionised SLV viscosity number is preferably at least 3 and generally at least 4, for instance up to 7, 8 or higher. Best results are obtained when it is above 5. Preferably it is higher than the deionised SLV viscosity number for the unbranched polymer, that is to say the polymer made under the same polymerisation conditions but in the absence of the branching agent (and therefore having higher intrinsic viscosity). If the deionised SLV viscosity number is not higher than the deionised SLV viscosity number of the unbranched polymer, preferably it is at least 50% and usually at least 75% of the deionised SLV viscosity number of the unbranched polymer. The salted SLV viscosity number is usually below 1. The deionised SLV viscosity number is often at least five times, and preferably at least eight times, the salted SLV viscosity number.

The water-soluble anionic branched polymer may suitably be added to the cellulosic suspension at a dose of at least 10 g per tonne based on the dry weight. The amount may be as much as 2000 or 3000 g per tonne or higher. Preferably the dose will be between 100 g per tonne and 1000 g per tonne, more preferably between 150 g per tonne and 750 g per tonne. More preferably still the dose will often be between 200 and 500 grams per tonne. All doses are based on weight of active polymer on the dry weight of cellulosic suspension.

The water-soluble anionic branched polymer may suitably be added at any convenient point in the process, for instance into the thin stock suspension or alternatively into the thick stock suspension. In some cases it may be desirable to add the anionic branched polymer into the mixing chest, blend chest or perhaps into one or more are the stock components. Preferably however, the anionic branched polymer is added into the thin stock. The exact point on the addition may be before one of the shear stages. Typically such shear stages include mixing, pumping and cleaning stages or other stages that induced mechanical degradation of flocs. Desirably the shear stages are selected from one of the fan pumps or centriscreens. Alternatively this anionic polymer may added after one or more of the fan pumps but before the centriscreen or in some cases after the centriscreen.

The shear stages may be regarded as mechanical shearing steps desirably act upon the flocculated suspension in such a way as to degrade the flocs. All the components of the retention/drainage system may be added prior to a shear stage although preferably at least the last component of the retention/drainage system is added to the cellulosic suspension at a point in the process where there is no substantial shearing before draining to form the sheet. Thus it is preferred that at least one component of the retention/drainage system is added to the cellulosic suspension and the flocculated suspension so formed is then subjected to mechanical shear wherein the flocs are mechanically degraded and then at least one component of the retention/drainage system is added to reflocculate the suspension prior to draining.

The first component of the retention/drainage system may be added to the cellulosic suspension and then the flocculated suspension so formed may be passed through one or more shear stages. The second component of retention/drainage system may be added to reflocculate the suspension, which reflocculated may then be subjected to further mechanical shearing. The sheared reflocculated suspension may also be further flocculated by addition of a third component of the retention/drainage system. A three component retention/drainage system is for instance where cationic coagulant is used in addition to the water-soluble cationic or amphoteric polymer and anionic branched polymer e.g. the so called cat/cat system and anionic branched polymer.

In the process the anionic polymer may be added after the addition of the water-soluble cationic or amphoteric polymer and/or after the addition of the cationic coagulant. However, we have found that particularly effective results in terms of improved ash retention relative to total retention but a decrease in drainage, when the anionic polymer is added to the cellulosic suspension prior to the addition of the water-soluble cationic or amphoteric polymer and also prior to the cationic coagulant. Consequently the water-soluble branched anionic polymer is desirably already present in the cellulosic suspension before addition of the water-soluble cationic or amphoteric polymer and where employed the cationic coagulant. This order of addition is unusual since been many known processes it is normal convention to add the cationic retention aid and especially any cationic coagulant prior to any anionic polymeric retention aid.

When the water-soluble branched anionic polymer is added to the cellulosic suspension it will normally bring about flocculation of the suspended solids. Preferably the cellulosic suspension is subjected to at least one stage that brings about mechanical degradation prior to the addition of the water-soluble cationic or amphoteric polymer and where employed the cationic coagulant. Generally the cellulosic suspension may be passed through one or more of these stages. Typically such stages are shear stages that include mixing, pumping and cleaning stages, such as one of the fan pumps or centriscreens. In a more preferred aspect of the process the water-soluble branched polymer is added prior to a centriscreen and the water-soluble cationic or amphoteric polymer and where employed the cationic coagulant is/are added to the cellulosic suspension after the centriscreen.

The filled paper may be any suitable paper made from a cellulosic suspension containing mechanical fibre and at least 10% by weight filler based on the dry weight of thin stock. For instance the paper may be a lightweight coated paper (LWC) or more preferably it is a super calendared paper (SC-paper).

By mechanical fibre we mean that the cellulosic suspension comprises mechanical pulp, indicating any wood pulp manufactured wholly or in part by a mechanical process, including stone ground wood (SGW), pressurised ground wood (PGW), thermomechanical pulp (TMP), chemithermomechanical pulp (CTMP) or bleached chemithermomechanical pulp (BCTMP). Mechanical paper grades contain different amounts of mechanical pulp, which is usually included in order to provide the desired optical and mechanical properties. In some cases the pulp used in making the filled paper may be formed of entirely of one or more of the aforementioned mechanical pulps. In addition to mechanical pulps other pulps are often included in the cellulosic suspension. Typically the other pulps may form at least 10% by weight of the total fibre content. These other pulps the included in the paper recipe include deinked pulp and sulphate pulp (often referred to as kraft pulp).

A preferred composition for SC paper is characterised in that the fibre faction contains deinked pulp, mechanical pulp and sulphate pulp. The mechanical pulp content may vary between 10 and 75%, preferably between 30 and 60% by weight of the total fibre content. The deinked pulp content (often referred to as DIP) may any between 0 and 90%, typically between 20 and 60% by weight of total fibre. The sulphate pulp content usually varies between 0 and 50%, preferably between 10 and 25% by weight of total fibre. The components when totalled should be 100%.

The cellulosic suspension may contain other ingredients such as cationic starch and/or coagulants. Typically this cationic starch and/or coagulants may be present in the paper stock in for the addition of the retention/drainage system of the present invention. The cationic starch may be present in an amount between 0 and 5%, typically between 0.2 and 1% by weight of cellulosic fibre. The coagulant will usually be added in amounts of up to 1% by weight of the cellulosic fibre, typically between 0.2 and 0.5%.

Desirably the filler may be a traditionally used filler material. For instance the filler may be a clay such as kaolin, or the may be a calcium carbonate which may be ground calcium carbonate or preferably precipitated calcium carbonate (PCC). Another preferred filler material includes titanium dioxide. Examples of other filler materials also include synthetic polymeric fillers.

In general the cellulosic stock used in the present invention will preferably comprise significant quantities of filler, usually greater than 10% based on dry weight of the cellulosic stock. However, usually a cellulosic stock that contains substantial quantities of filler is more difficult to flocculate than cellulosic stocks used the may have paper grades that contain no or less filler. This is particularly true of fillers of very fine particle size, such as precipitated calcium carbonate, introduced to the paper stock as a separate additive or as sometimes is the case added with deinked pulp.

The present invention enables highly filled paper to be made from cellulosic stock containing high levels of filler and also containing mechanical fibre, such as SC paper or coated rotogravure paper, for instance LWC with excellent retention and formation and maintained or reduced drainage which allows for better control of the drainage of the stock on the machine wire. Typically the paper making stock will need to contain significant levels of filler in the thin stock, usually at least 25% or at least 30% by weight of dry suspension. Frequently the amount of filler in the headbox furnish before draining the suspension to form a sheet is up to 70% by weight of dry suspension, preferably between 50 and 65% of filler. Desirably the final sheet of paper will comprise up to 40% filler by weight. It should be noted that typical SC paper grades contain between 25 and 35% filler in the sheet.

Preferably the process is operated using an extremely fast draining paper machine, especially those paper machines that have extremely fast draining twin wire forming sections, in particular those machines referred to as Gapformers or Hybridformers. The invention is particularly suitable for the production of highly filled mechanical grade papers, such as SC paper on paper machines where an excess of initial drainage would otherwise result. The process enables retention, drainage and formation to be balanced in an optimised fashion typically on paper machines known as Gapformers and Hybridformers.

In the process of the present invention we find that in general the first pass total and ash retention may be adjusted to any suitable level depending upon the process and production needs. SC paper grades are usually produced at lower total and ash retention levels than other paper grades, such as fine paper, highly filled copy paper, paperboard or newsprint. Generally first pass total retention levels range from 30 to 60% by weight, typically from between 35 and 50%. Usually ash retention level may be in the range of from 15 to 45% by weight, typically between 20 and 35%.

The following examples illustrate the invention.

EXAMPLES

Methods

1. Preparation of Polymers

All polymers and coagulants are prepared as 0.1% aqueous solutions based on actives. The premixes consist of 50% high molecular weight polymer and 50% coagulant and are blended together as 0.1% aqueous solutions before their addition to the furnish.

Starch was prepared as 1% aqueous solution.

2. Polymers Used for the Examples

Polymer A: linear polyacrylamide, IV=9, 20% cationic charge. A copolymer of acrylamide with methyl chloride quaternary ammonium salt of dimethylaminoethyl acrylate (80/20 wt./wt.) of intrinsic viscosity above 9.0 dL/g.

Polymer B: Anionic branched copolymer of acrylamide with sodium acrylamide (60/40) made with 3.5 to 5.0 ppm by weight methylene bis acrylamide branching agent. The product is supplied as a mineral oil based dispersion with 50% actives.

Polymer C: A 50% aqueous polyamine=poly(epichlorhydrindimethylamine) solution with 50% actives, 6-7.0 milleq/g, IV=0.2; GPC molecular weight 140.000

Polymer D: PolyDADMAC in aqueous solution with 20% actives and IV of 1.4 dL/g. 6.2 millieq/g.

Polymer E: Modified polyethyleneimine in aqueous solution with 24% actives.

System A=Polymer A, added post screen

System B=Premix of 50% Polymer A and 50% Polymer C, added post screen

System C=Premix of 50% Polymer A and 50% Polymer E, added post screen

System D=Premix of 50% Polymer A and 50% Polymer D, added post screen

System E=Polymer A, added pre screen

System F=Premix of 50% Polymer A and 50% Polymer D, added pre screen

3. Paper Furnishes

Fine Paper Furnish 1

This alkaline, cellulosic fine paper suspension comprises solids, which are made up of about 90 weight % fibre and about 10% precipitated calcium carbonate filler (PCC). The PCC used is "Calopake F" in dry form from Specialty Minerals Lifford/UK. The employed fibre fraction is a 70/30 weight % blend of bleached birch and bleached pine, beaten to a Schopper Riegler freeness of 48° to provide enough fines for realistic testing conditions. The furnish is diluted with tap water to a consistency of about 0.61 weight %, comprising fines of about 18.3 weight %, split up into approximately 50% ash and 50% fibre fines. 0.5 kg/t polyaluminiumchloride (Alcofix 905) and 5 kg/t (on total solids) cationic starch (Raisamyl 50021) with a DS value of 0.035 based on dry weight is added to the paper stock. The pH of the fine paper furnish is 7.4±0.1, the conductivity about 500 μS/m and the zeta potential about −14.3 mV.

Fine Paper Furnish 2

This alkaline fine paper furnish is made of a 70/30 weight % blend of bleached birch and bleached pine, beaten to a Schopper Riegler freeness of 52° and supplemented with precipitated calcium carbonate slurry to an ash content of about 21.1 weight %. The cellulosic suspension is diluted to 0.46 weight % solids, comprising fines of about 32 weight %, wherein approximately 61% ash and 39% fibre fines are included. 5 kg/t (on total solids) cationic starch (Raisamyl 50021) with a DS value of 0.035 based on dry weight is added to the paper stock. The pH of the final mechanical furnish is 7.5±0.1, the conductivity about 360 μS/m and the zeta potential about −22 mV.

Fine Paper Furnish 3

The cellulosic stock is made to 0.46 weight % consistency according to fine paper furnish 2. The ash content is about 18.9%, the zeta potential is −22 mV.

Fine Paper Furnish 4

This alkaline fine paper furnish is made of a 70/30 weight % blend of bleached birch and bleached pine, beaten to a Schopper Riegler freeness of 45° and supplemented with precipitated calcium carbonate slurry to an ash content of about 46 weight %. The cellulosic suspension is diluted to 0.58 weight % solids, comprising fines of about 53 weight %, wherein approximately 84% ash and 16% fibre fines are included. 5 kg/t (on total solids) cationic starch (Raisamyl 50021) with a DS value of 0.035 based on dry weight is added to the paper stock. Conductivity is raised with calcium chloride to 1750 μS/m. The pH of the final mechanical furnish is 7.5±0.1, the zeta potential about −7 mV.

Deinked Mechanical Pulp (DIP)

The deinked recycled pulp furnish is an ONP/OMG (old newsprint/old magazine) mix of about 100 Canadian standard freeness. It is supplemented with precipitated calcium carbonate slurry (Omya F14960) to an ash content of about 56.7 weight %. This furnish is diluted with tap water to a final consistency of app. 0.45 weight %, comprising fines of about 65 weight %, spitted up into approximately 82% ash and 18% fibre fines. The pH of the final paper furnish is 7.4±0.1., the conductivity about 370 μS/m and a zeta potential about −50 mV. A highly filled DIP furnish is for instance suitable for SCB paper production.

Mechanical Furnish 1

A peroxide bleached mechanical pulp of 60 Canadian standard freeness is supplemented with "Calopake F", a PCC in dry form from Specialty Minerals Lifford/UK to an ash content of about 20.6 weight % and diluted to a consistency of about 4.8 g/L, comprising fines of about 33.8 weight %, which the constituents of fines are approximately 54.5% ash and 45.5% fibre fines. The final furnish has a Schopper Riegler freeness of about 40°. 0.5 kg/t polyaluminiumchloride (Alcofix 905) and 5 kg/t (on total solids) cationic starch (Raisamyl 50021) with a DS value of 0.035 based on dry weight is added to the paper stock. The pH of the fine paper furnish is 7.4±0.1., the conductivity is about 500 μS/m and the zeta potential is about −23.5 mV.

Mechanical Furnish 2

A peroxide bleached mechanical pulp of 60 Canadian standard freeness is supplemented with precipitated calcium carbonate slurry (Omya F14960) to an ash content of about 10.2 weight % and diluted to a consistency of about 4.6 g/L, comprising fines of about 28 weight %, in which the fines are divided into approximately 35% ash and 65% fibre fines. 5 kg/t (on total solids) cationic starch (Raisamyl 50021) with a DS value of 0.035 based on dry weight is added to the paper stock. The pH of the final mechanical furnish is 7.5±0.1, the conductivity about 400 μS/m and the zeta potential about −30 mV.

Mechanical Furnish 3

A peroxide bleached mechanical pulp of 60 Canadian standard freeness is supplemented with precipitated calcium carbonate slurry (Omya F14960) to an ash content of about 21.8 weight % and diluted to a consistency of about 0.45 weight %, comprising fines of about 40 weight %, the fines containing approximately 56% ash and 44% fibre fines. 5 kg/t (on total solids) cationic starch (Raisamyl 50021) with a DS value of 0.035 based on dry weight is added to the paper stock. The pH of the final mechanical furnish is 7.5±0.1, the conductivity about 400 μS/m and the zeta potential about −31 mV.

Mechanical Furnish 4

A peroxide bleached mechanical pulp of 60 Canadian standard freeness is supplemented with precipitated calcium carbonate slurry (Omya F14960) to an ash content of about 48 weight % and diluted to a consistency of about 0.46 weight %, comprising fines of about 56 weight %, wherein approximately 80% ash and 20% fibre fines are included. 5 kg/t (on total solids) cationic starch (Raisamyl 50021) with a DS value of 0.035 based on dry weight is added to the paper stock. The pH of the final mechanical furnish is 7.5±0.1, the conductivity about 400 μS/m and the zeta potential about −36 mV.

SC Furnish 1

The cellulosic stock used to conduct the examples is typical wood containing paper furnish to make SC-paper. It consists of 18% deinked pulp, 21.5% unbleached stone ground wood and 50% mineral filler comprising 50% precipitated calcium carbonate (PCC) and 50% clay. The PCC is Omya F14960, an aqueous dispersion of precipitated calcium carbonate with 1% auxiliary substances for the use in SC paper. The Clay is Intramax SC Slurry from IMERYS. The final stock has a consistency of 0.75%, a total ash content of about 54%, a freeness of 69° SR (Schopper Riegler method), conductivity of 1800 μS/m and a fines content of 65%, wherein approximately 80% ash and 20% fibre fines are included. 2 kg/t (on total solids) cationic starch (Raisamyl 50021) with a DS value of 0.035 based on dry weight is added to the paper stock.

SC Furnish 2

The cellulosic stock with 50% ash content is made to 0.75% consistency according to furnish 1, except that another deinked pulp was used. The freeness is 64° SR, the fines content is 50 weight %.

4. Free/Initial Drainage

The drainage properties are determined using a modified Schopper-Riegler apparatus with the rear exit blocked so that the drainage water exits through the front opening. The drainage performance is displayed as drainage rate describing how many milliliters are released through the Schopper-Riegler wire per minute. The dosing sequence is the same as outlined for the Scanning Laser Microscopy and Moving Belt Former experiments. The paper stock is drained after stirring it for 75 seconds in accordance to the SLM protocol.

5. First Total and Ash Retention

Paper sheets of 19 $cm^2$ were made with a moving belt former by using 400-500 mL of paper stock depending on furnish type and consistency. The sheets are weighed in order to determine first pass total and ash retention using the following formula:

$$FPTR[\%]=\text{Sheet weight [g]/Total amount of paper stock based on dry weight [g]}*100$$

$$FPTAR[\%]=\text{Ash content in sheet [g]/total amount of paper stock ash based on dry weight [g]}*100$$

First pass ash retention, for simplicity often referred to as ash retention, is relative to total retention directly related to the sheet ash content. This is representative of the filler retention. In order to demonstrate the invention by means of realistic paper sheet compositions, the relationship between the effects of ash retention and drainage are displayed as free drainage rate over ash content in the sheet.

The Moving Belt Former (MBF) from the Helsinki University of Technology simulates the wet end part of a conventional fourdrinier machine (single wire machine) in laboratory scale and is used to make hand sheets. The pulp slurry is formed on a fabric, which is exactly the same used in commercial paper and board machines. A moving perforated cogged belt produces the scraping effect and pulsation, simulating water removal elements, foils and vacuum boxes, located in the wire section. There is a vacuum box under the cogged belt. The vacuum level, belt speed and effective suction time and other operating parameters are controlled by a computer system. Typical pulsation frequency range is 50-100 Hz and effective suction time ranges from 0 to 500 ms. On top of the wire is a mixing chamber similar to the Britt Jar where the furnish is sheared with a speed controlled propeller before draining it to form a sheet. A detailed description of the MBF is given in "Advanced wire part simulation with a moving belt former and its applicability in scale up on rotogravure printing paper", Strengell, K., Stenbacka, U., Ala-Nikkola, J. in Pulp & Paper Canada 105 (3) (2004), T62-66. The retention and drainage chemicals are dosed into this mixing chamber as outlined in the protocol below (see table 1). It should be noted that the dosing protocols for Scanning Laser Microscopy and MBF experiments are the same in order to conjoin results from Schopper Riegler, Scanning Laser Microscopy and MBF.

TABLE 1

Moving Belt Former Computer controlled test protocol

| Time [seconds] | Action |
|---|---|
| 0 | Start with stirrer set at 1500 rpm |
| 12 | Add $1^{st}$ retention aid |
| 30 | Stirrer at 500 rpm; add $2^{nd}$ retention aid |
| 45 | Stirrer at 1500 rpm |
| 75 | Start drainage to from a sheet |

6. SLM (Scanning Laser Microscopy)

The scanning laser microscopy, often referred to as FBRM (focused beam laser reflectance measurement), employed in the following examples is a real time particle size distribution measurement and outlined in U.S. Pat. No. 4,871,251, issued to Preikschat, F. K. and E. (1989). It consists of a 780 nm focused, rotating laser beam that is scanned thru suspension of interest at 2-4 m/s velocity. Particles and flocs are crossed by the laser beam and reflect some of the light back to the probe. The duration time of light reflection is detected and transformed into a chord length [m/s*s=m]. Measurements are not influenced by sample flow velocities <1800 rpm, since scanning velocity of the laser is much faster than the mixing velocity. Backscattered light pulses are used to form a histogram of 90 log particle size channels between 0.8 and 1000 micrometer with particle number/time over chord length. The raw data can be presented in different ways such as number of particles or chord length over time. Mean, Median and their derivates as well as various particle size ranges can be selected to describe the observed process. Commercial instruments are available under trade name "Lasentec FBRM" from Mettler Toledo, Switzerland. Further information about using SLM for monitoring flocculation can be found in "Flocculation monitoring: focused beam reflectance measurement as measurement tool", Blanco, A., Fuente, E., Negro, C., Tijero, C. in Canadian Journal of Chemical Engineering (229), 80(4), 734-740. Publisher: Canadian Society for Chemical Engineering.

The objective of SLM experiments is determining the number flocs, here described as the dimensional parameter of chord length, in the upper range of the particle size distribution at the time when the sheet is formed on the wire. In accordance to the protocol this time point is 75 seconds. Large sized cellulosic aggregates contribute to an uneven appearance of the paper sheet and deteriorated formation. FIG. 1 illustrates the unweighted chord length distribution versus the channel boundaries in microns. As common in particle science, the chord lengths are cube weighted to emphasize the larger aggregates. Thus FIG. 2 illustrates the cube weighted chord length distribution of a flocculated SC furnish versus the channel boundaries in microns. As can be seen from FIGS. 1 and 2, the range between 170 and 460 nm describes the upper limit of chord lengths for the concerning furnish. Hence the number of particles in this particular range is measured as counts per seconds.

The experiment itself consists of taking 500 mL of paper stock and placing this in the appropriate mixing beaker. The furnish is stirred and sheared with a variable speed motor and a propeller similar to as a standard Britt Jar set up. The applied dosing sequence is same as used for the moving belt former and shown below (see table 2):

TABLE 2

Scanning Laser Microscopy Test protocol

| Time [seconds] | Action |
|---|---|
| 0 | Start with stirrer set at 1500 rpm |
| 12 | Add 1$^{st}$ retention aid |
| 30 | Set stirrer at 500 rpm; add 2$^{nd}$ retention aid |
| 45 | Set stirrer at 1500 rpm |
| 75 | Stop experiment |

Example I

Fine Paper Furnish 1 with System E

Example I shows a retention and drainage concept for a chemical pulp furnish as described in WO-A-9829604 comprising a first polymeric cationic retention aid (system E) to form cellulosic flocs, mechanically degrading the flocs, reflocculating the suspension by adding a second, water soluble anionic branched polymeric retention aid (polymer B) to form a sheet. As expected, total and ash retention as well as the drainage rate increase simultaneously. For instance lead 800 g/t of system E to a total retention of about 95%, to ash retention of about 73% and to a drainage rate of 625 ml/min. In contrast only 200 g/t of system E followed by 100 g/t polymer B lead to similar retention results and a higher drainage rate of 652 ml/min (see tables I.1, I.2 and FIG. 1). Thus no decoupling effect occurs that would enable the papermaker to adjust the desired ratio between total or ash retention and in addition the drainage rate.

TABLE I.1

No addition of polymer B, dosage of system E = variable

| Dosage of System E [g/t] | First Pass Total Retention [%] | First Pass Total Ash Retention [%] | Ash content in sheet [%] | Free Drainage Rate [mL/min] | Basis weight [g/m$^2$] |
|---|---|---|---|---|---|
| 200 | 93.6 | 64.1 | 6.9 | 545 | 83.9 |
| 400 | 93.6 | 66.8 | 7.1 | 588 | 83.9 |
| 800 | 94.5 | 73.1 | 7.7 | 625 | 84.7 |
| 1000 | 97.6 | 76.7 | 7.9 | 638 | 87.5 |

TABLE I.2

100 g/t polymer B = const., dosage of system E = variable

| Dosage of System E [g/t] | First Pass Total Retention [%] | First Pass Total Ash Retention [%] | Ash content in sheet [%] | Free Drainage Rate [mL/min] | Basis weight [g/m$^2$] |
|---|---|---|---|---|---|
| 50 | 87.5 | 60.6 | 6.9 | 566 | 78.5 |
| 100 | 90.2 | 63.9 | 7.1 | 625 | 80.8 |
| 200 | 95.3 | 72.5 | 7.6 | 652 | 85.4 |
| 300 | 98.0 | 76.2 | 7.8 | 714 | 87.9 |

Example II

Fine Paper Furnish_2 with System A

This example shows the impact of polymer B added prior to system A concerning the decoupled events of retention and drainage in fine paper. As shown in FIG. 2A the drainage profile of system A over ash content in the sheet remains unchanged. From this it follows that this preferred form of the invention does not work in chemical pulp or in other words it is not suitable for delignified fibres (see tables II.1, II.2 and FIG. 2B).

Furthermore retention deteriorates on an active polymer basis, identified as polymer B+system A (see FIG. 2B). The flocculation process becomes uneconomic and does neither provide a technical nor a cost benefit for the papermaker.

TABLE II.1

No addition of polymer B, dosage of system A = variable

| Dosage of System A [g/t] | First Pass Total Retention [%] | First Pass Total Ash Retention [%] | Ash content in sheet [%] | Free Drainage Rate [mL/min] | Basis weight [g/m$^2$] |
|---|---|---|---|---|---|
| 200 | 78.8 | 42.7 | 11.4 | 649 | 53.2 |
| 400 | 80.1 | 51.4 | 13.5 | 758 | 54.1 |
| 600 | 82.3 | 57.3 | 14.7 | 826 | 55.6 |
| 800 | 82.4 | 59.4 | 15.2 | 866 | 55.7 |
| 1200 | 83.0 | 63.2 | 16.1 | 957 | 56.1 |

TABLE II.2

250 g/t polymer B = const., dosage of system A = variable

| Dosage of System A [g/t] | First Pass Total Retention [%] | First Pass Total Ash Retention [%] | Ash content in sheet [%] | Free Drainage Rate [mL/min] | Basis weight [g/m$^2$] |
|---|---|---|---|---|---|
| 400 | 76.8 | 38.7 | 10.6 | 627 | 51.9 |
| 600 | 79.6 | 44.1 | 11.7 | 673 | 53.8 |

TABLE II.2-continued

| 250 g/t polymer B = const., dosage of system A = variable | | | | | |
|---|---|---|---|---|---|
| Dosage of System A [g/t] | First Pass Total Retention [%] | First Pass Total Ash Retention [%] | Ash content in sheet [%] | Free Drainage Rate [mL/min] | Basis weight [g/m$^2$] |
| 800 | 80.8 | 47.7 | 12.4 | 699 | 54.6 |
| 1000 | 80.4 | 50.3 | 13.2 | 727 | 54.4 |
| 1400 | 81.9 | 55.8 | 14.4 | 791 | 55.4 |

Example III

Fine Paper Furnish 3 with Systems C and D

Example III underlines the findings from example II, in particular that the anionic branched polymer B added prior to cat/cat systems with an intermediate shear step does not provide similar or improved ash retention and reduced drainage at the same time. System C is a typical cat/cat system based on a polyacrylamide and a polyethyleneimine, whereas system D represents a polyDADMAC containing cat/cat system (see tables III.1-4 as well as FIGS. 3A and 3B).

TABLE III.1

| No addition of polymer B, dosage of system C = variable | | | | | |
|---|---|---|---|---|---|
| Dosage of System C [g/t] | First Pass Total Retention [%] | First Pass Total Ash Retention [%] | Ash content in sheet [%] | Free Drainage Rate [mL/min] | Basis weight [g/m$^2$] |
| 50 | 66.7 | 5.3 | 1.5 | 714 | 56.3 |
| 100 | 67.9 | 10.0 | 2.8 | 714 | 57.4 |
| 200 | 72.1 | 24.3 | 6.4 | 698 | 60.9 |
| 300 | 74.9 | 32.1 | 8.1 | 750 | 63.3 |
| 400 | 76.6 | 44.3 | 10.9 | 811 | 64.7 |
| 500 | 79.1 | 48.3 | 11.5 | 938 | 66.9 |

TABLE III.2

| 250 g/t polymer B = const., dosage of system C = variable | | | | | |
|---|---|---|---|---|---|
| Dosage of System C [g/t] | First Pass Total Retention [%] | First Pass Total Ash Retention [%] | Ash content in sheet [%] | Free Drainage Rate [mL/min] | Basis weight [g/m$^2$] |
| 50 | 72.8 | 28.2 | 7.3 | 667 | 61.5 |
| 100 | 72.2 | 32.6 | 8.5 | 714 | 61.0 |
| 200 | 72.6 | 29.8 | 7.8 | 698 | 61.3 |
| 300 | 75.2 | 36.8 | 9.2 | 789 | 63.5 |
| 400 | 74.0 | 38.0 | 9.7 | 769 | 62.5 |
| 500 | 75.3 | 41.1 | 10.3 | 811 | 63.7 |
| 600 | 76.4 | 49.1 | 12.1 | 1000 | 64.6 |

TABLE III.3

| No addition of polymer B, dosage of system D = variable | | | | | |
|---|---|---|---|---|---|
| Dosage of System D [g/t] | First Pass Total Retention [%] | First Pass Total Ash Retention [%] | Ash content in sheet [%] | Free Drainage Rate [mL/min] | Basis weight [g/m$^2$] |
| 100 | 68.4 | 17.3 | 4.7 | 714 | 59.1 |
| 200 | 70.0 | 33.6 | 8.7 | 732 | 61.6 |
| 300 | 72.9 | 38.8 | 9.7 | 769 | 64.2 |
| 400 | 76.0 | 43.6 | 10.8 | 811 | 64.4 |
| 500 | 76.8 | 38.5 | 9.5 | 789 | 64.9 |

TABLE III.4

| 250 g/t polymer B = const., dosage of system D = variable | | | | | |
|---|---|---|---|---|---|
| Dosage of System D [g/t] | First Pass Total Retention [%] | First Pass Total Ash Retention [%] | Ash content in sheet [%] | Free Drainage Rate [mL/min] | Basis weight [g/m$^2$] |
| 50 | 71.6 | 29.5 | 7.8 | 732 | 60.5 |
| 100 | 72.3 | 24.7 | 6.5 | 714 | 61.1 |
| 200 | 74.0 | 29.4 | 7.5 | 698 | 62.6 |
| 300 | 73.7 | 39.7 | 10.2 | 789 | 62.3 |
| 500 | 75.0 | 45.9 | 11.6 | 811 | 63.4 |
| 600 | 78.2 | 51.3 | 12.4 | 857 | 66.0 |

Example IV

Fine Paper Furnish 4 with System A

The purpose of this example is to show that decoupling of ash retention and drainage is also not achieved at higher ash levels in fine paper furnish, as it might be used for the production of highly filled copy paper (see tables IV.1, IV.2 and FIG. 4).

TABLE IV.1

| No addition of polymer B, dosage of system A = variable | | | | | |
|---|---|---|---|---|---|
| Dosage of System A [g/t] | First Pass Total Retention [%] | First Pass Total Ash Retention [%] | Ash content in sheet [%] | Free Drainage Rate [mL/min] | Basis weight [g/m$^2$] |
| 200 | 62.4 | 27.3 | 20.1 | 625 | 53.2 |
| 400 | 69.2 | 41.9 | 27.9 | 670 | 58.9 |
| 600 | 71.3 | 48.6 | 31.4 | 694 | 60.7 |
| 1000 | 73.4 | 55.0 | 34.4 | 735 | 62.6 |

TABLE IV.2

| 250 g/t polymer B = const., dosage of system A = variable | | | | | |
|---|---|---|---|---|---|
| Dosage of System A [g/t] | First Pass Total Retention [%] | First Pass Total Ash Retention [%] | Ash content in sheet [%] | Free Drainage Rate [mL/min] | Basis weight [g/m$^2$] |
| 200 | 68.7 | 37.2 | 24.9 | 670 | 58.6 |
| 400 | 69.9 | 40.8 | 26.8 | 708 | 59.6 |
| 600 | 71.3 | 46.9 | 30.3 | 721 | 60.8 |
| 1000 | 72.9 | 53.2 | 33.6 | 750 | 62.1 |

Example V

Deinked Recycled Pulp (DIP) with Systems A and B

Example V demonstrates exemplarily on DIP furnish that the decoupling effect as defined in the invention does not occur in recycled fibre furnishes. Retention and drainage are simultaneously increased regardless of which a single high molecular weight flocculant or a cat/cat system is used. Thus an economic, independent drainage control is not provided (see tables V.1-4 as well as FIGS. 5A and 5B).

TABLE V.1

No addition of polymer B; Dosage of system A = variable

| Dosage of System A [g/t] | First Pass Total Retention [%] | First Pass Total Ash Retention [%] | Ash content in sheet [%] | Free Drainage Rate [mL/min] | Basis weight [g/m$^2$] |
|---|---|---|---|---|---|
| 400 | 54.4 | 27.2 | 28.3 | 938 | 36.0 |
| 600 | 60.8 | 36.2 | 33.8 | 1014 | 40.2 |
| 800 | 66.4 | 45.0 | 38.4 | 1210 | 43.9 |
| 1200 | 73.1 | 55.1 | 42.7 | 1500 | 48.3 |

TABLE V.2

250 g/t polymer B = const., dosage of system A = variable

| Dosage of System A [g/t] | First Pass Total Retention [%] | First Pass Total Ash Retention [%] | Ash content in sheet [%] | Free Drainage Rate [mL/min] | Basis weight [g/m$^2$] |
|---|---|---|---|---|---|
| 400 | 55.7 | 25.5 | 26.0 | 872 | 35.8 |
| 600 | 62.4 | 35.0 | 31.8 | 1136 | 39.8 |
| 800 | 68.9 | 45.0 | 37.0 | 1293 | 42.8 |

TABLE V.3

No addition of polymer B, dosage of system B = variable

| Dosage of System B [g/t] | First Pass Total Retention [%] | First Pass Total Ash Retention [%] | Ash content in sheet [%] | Free Drainage Rate [mL/min] | Basis weight [g/m$^2$] |
|---|---|---|---|---|---|
| 600 | 51.8 | 22.2 | 24.3 | 852 | 34.2 |
| 800 | 56.3 | 26.7 | 26.9 | 987 | 37.2 |
| 1000 | 59.4 | 33.6 | 32.0 | 1014 | 39.3 |
| 1600 | 66.3 | 44.5 | 38.1 | 1136 | 43.8 |

TABLE V.4

250 g/t polymer B = const., dosage of system B = variable

| Dosage of System B [g/t] | First Pass Total Retention [%] | First Pass Total Ash Retention [%] | Ash content in sheet [%] | Free Drainage Rate [mL/min] | Basis weight [g/m$^2$] |
|---|---|---|---|---|---|
| 400 | 54.2 | 26.7 | 27.9 | 1071 | 35.8 |
| 600 | 60.2 | 31.6 | 29.7 | 1136 | 39.8 |
| 800 | 64.7 | 41.4 | 36.3 | 1293 | 42.8 |

Example VI

Mechanical Furnish 1 with System E

The mechanical furnish in this example is similarly prepared to fine paper furnish 1 in terms of PAC and starch addition. System E is likewise applied in conjunction with 100 g/t of polymer B. Unexpectedly total and ash retention increases and drainage rate reduces simultaneously. For instance lead 800 g/t of system E to a total retention of about 77%, to ash retention of about 47% and to a drainage rate of 1008 ml/min. In contrast 400 g/t of system E followed by 100 g/t polymer B lead to similar retention results and a lower drainage rate of 929 ml/min (see tables VI.1, VI.2 and FIG. 6). Thus the increase in total and ash retention is decoupled from the drainage rate. The papermaker can now adjust the desired ratio between ash retention and drainage by levelling the two components.

TABLE VI.1

No addition of polymer B, dosage of system E = variable

| Dosage of System E [g/t] | First Pass Total Retention [%] | First Pass Total Ash Retention [%] | Ash content in sheet [%] | Free Drainage Rate [mL/min] | Basis weight [g/m$^2$] |
|---|---|---|---|---|---|
| 600 | 77.8 | 37.8 | 10.0 | 905 | 54.8 |
| 800 | 77.2 | 47.1 | 12.6 | 1008 | 54.4 |
| 1200 | 77.0 | 51.4 | 13.7 | 1103 | 54.3 |

TABLE VI.2

100 g/t polymer B = const., dosage of system E = variable

| Dosage of System E [g/t] | First Pass Total Retention [%] | First Pass Total Ash Retention [%] | Ash content in sheet [%] | Free Drainage Rate [mL/min] | Basis weight [g/m$^2$] |
|---|---|---|---|---|---|
| 200 | 72.6 | 39.0 | 11.1 | 882 | 51.2 |
| 400 | 76.7 | 46.7 | 12.5 | 929 | 54.1 |
| 600 | 76.7 | 51.5 | 13.8 | 1008 | 54.1 |

Example VII

Mechanical Furnish 2 with System A and B

FIGS. 7A and 7B clearly show that the application of polymer B in conjunction with system A and B in a mechanical furnish brings a significant improvement in ash retention relative to total retention with simultaneously reducing drainage (see also tables VII.1-4). On the basis of this effect as well as further dosage adaptation, the desired ratio between retention and drainage can be adjusted. A furnish leading to ash levels of about 6 to 8 weight % in the sheet could for instance model a newsprint furnish.

TABLE VII.1

No addition of polymer B, dosage of system A = variable

| Dosage of System A [g/t] | First Pass Total Retention [%] | First Pass Total Ash Retention [%] | Ash content in sheet [%] | Free Drainage Rate [mL/min] | Basis weight [g/m$^2$] |
|---|---|---|---|---|---|
| 200 | 82.0 | 34.1 | 4.2 | 727 | 55.4 |
| 400 | 85.9 | 51.7 | 6.1 | 866 | 58.1 |
| 600 | 87.9 | 62.2 | 7.2 | 1010 | 59.4 |
| 800 | 90.2 | 63.6 | 7.2 | 1070 | 61.0 |
| 1200 | 90.4 | 74.8 | 8.4 | 1212 | 61.1 |

TABLE VII.2

250 g/t polymer B = const., dosage of system A = variable

| Dosage of System A [g/t] | First Pass Total Retention [%] | First Pass Total Ash Retention [%] | Ash content in sheet [%] | Free Drainage Rate [mL/min] | Basis weight [g/m$^2$] |
|---|---|---|---|---|---|
| 200 | 83.0 | 49.4 | 6.1 | 673 | 56.1 |
| 400 | 85.7 | 56.5 | 6.7 | 758 | 57.9 |
| 600 | 86.9 | 62.1 | 7.3 | 791 | 58.7 |
| 800 | 88.0 | 67.2 | 7.8 | 866 | 59.5 |

TABLE VII.3

No addition of polymer B, dosage of system B = variable

| Dosage of System B [g/t] | First Pass Total Retention [%] | First Pass Total Ash Retention [%] | Ash content in sheet [%] | Free Drainage Rate [mL/min] | Basis weight [g/m$^2$] |
|---|---|---|---|---|---|
| 400 | 56.4 | 39.3 | 4.8 | 727 | 56.4 |
| 600 | 57.3 | 46.0 | 5.5 | 791 | 57.3 |
| 800 | 57.9 | 50.8 | 6.1 | 826 | 57.9 |
| 1000 | 58.8 | 52.0 | 6.1 | 866 | 58.8 |
| 1600 | 60.4 | 63.1 | 7.2 | 957 | 60.4 |

TABLE VII.4

250 g/t polymer B = const., dosage of system B = variable

| Dosage of System B [g/t] | First Pass Total Retention [%] | First Pass Total Ash Retention [%] | Ash content in sheet [%] | Free Drainage Rate [mL/min] | Basis weight [g/m$^2$] |
|---|---|---|---|---|---|
| 200 | 54.3 | 41.1 | 5.2 | 649 | 54.3 |
| 400 | 57.8 | 54.9 | 6.5 | 727 | 57.8 |
| 600 | 58.7 | 64.8 | 7.6 | 866 | 58.7 |
| 800 | 60.2 | 69.4 | 7.9 | 957 | 60.2 |

Example VIII

Mechanical Furnish 3 with Systems A, B, D, E and G

The examples being carried out on mechanical furnish 2 show that the scope of invention covers also higher filled mechanical papers, such as improved newsprint or LWC. In FIG. 8A polymer B reduces the free/initial drainage of system A. If the single flocculant is dosed prior to polymer B, here referred to as system E, similar drainage results are obtained (see tables VIII.1, 2, 3 and FIG. 8A). The cat/cat systems B, D and G, representing polyamine and polyDADMAC containing polymer blends, behave like system A and exhibit strong decoupling effects (see tables VIII.48 and FIGS. 8B and 8C).

TABLE VIII.1

No addition of polymer B, dosage of system A = variable

| Dosage of System A [g/t] | First Pass Total Retention [%] | First Pass Total Ash Retention [%] | Ash content in sheet [%] | Free Drainage Rate [mL/min] | Basis weight [g/m$^2$] |
|---|---|---|---|---|---|
| 200 | 71.2 | 23.1 | 7.1 | 1070 | 47.1 |
| 400 | 73.8 | 36.2 | 10.7 | 1212 | 48.8 |
| 600 | 77.8 | 41.6 | 11.7 | 1299 | 51.4 |
| 800 | 79.7 | 48.1 | 13.2 | 1399 | 52.7 |
| 1200 | 82.1 | 59.1 | 15.7 | 1515 | 54.3 |

TABLE VIII.2

250 g/t polymer B = const., dosage of system A = variable

| Dosage of System A [g/t] | First Pass Total Retention [%] | First Pass Total Ash Retention [%] | Ash content in sheet [%] | Free Drainage Rate [mL/min] | Basis weight [g/m$^2$] |
|---|---|---|---|---|---|
| 200 | 72.7 | 32.0 | 9.6 | 1010 | 48.0 |
| 400 | 74.6 | 40.1 | 11.7 | 1070 | 49.3 |

TABLE VIII.2-continued 250 g/t polymer B = const., dosage of system A = variable

| Dosage of System A [g/t] | First Pass Total Retention [%] | First Pass Total Ash Retention [%] | Ash content in sheet [%] | Free Drainage Rate [mL/min] | Basis weight [g/m$^2$] |
|---|---|---|---|---|---|
| 600 | 77.4 | 47.5 | 13.4 | 1136 | 51.2 |
| 800 | 78.9 | 53.2 | 14.7 | 1299 | 52.2 |

TABLE VIII.3

250 g/t polymer B = const., dosage of system E = variable

| Dosage of System E [g/t] | First Pass Total Retention [%] | First Pass Total Ash Retention [%] | Ash content in sheet [%] | Free Drainage Rate [mL/min] | Basis weight [g/m$^2$] |
|---|---|---|---|---|---|
| 200 | 73.0 | 30.0 | 8.9 | 957 | 48.3 |
| 400 | 77.7 | 42.4 | 11.9 | 1136 | 51.3 |
| 600 | 78.9 | 48.3 | 13.3 | 1212 | 52.2 |

TABLE VIII.4

No addition of polymer B, dosage of system B = variable

| Dosage of System B [g/t] | First Pass Total Retention [%] | First Pass Total Ash Retention [%] | Ash content in sheet [%] | Free Drainage Rate [mL/min] | Basis weight [g/m$^2$] |
|---|---|---|---|---|---|
| 400 | 71.1 | 22.9 | 7.0 | 1010 | 47.0 |
| 600 | 73.5 | 29.4 | 8.7 | 1070 | 48.6 |
| 800 | 74.4 | 28.9 | 8.5 | 1136 | 49.2 |
| 1000 | 75.5 | 37.6 | 10.9 | 1212 | 49.9 |
| 1600 | 76.2 | 38.4 | 11.0 | 1399 | 50.4 |

TABLE VIII.5

250 g/t polymer B = const., dosage of System B = variable

| Dosage of System B [g/t] | First Pass Total Retention [%] | First Pass Total Ash Retention [%] | Ash content in sheet [%] | Free Drainage Rate [mL/min] | Basis weight [g/m$^2$] |
|---|---|---|---|---|---|
| 200 | 72.3 | 29.8 | 9.0 | 909 | 47.8 |
| 400 | 75.1 | 41.3 | 12.0 | 1070 | 49.7 |
| 600 | 76.2 | 43.6 | 12.5 | 1136 | 50.4 |
| 800 | 78.7 | 51.6 | 14.3 | 1299 | 52.0 |

TABLE VIII.6

No addition of polymer B, dosage of system D = variable

| Dosage of System D [g/t] | First Pass Total Retention [%] | First Pass Total Ash Retention [%] | Ash content in sheet [%] | Free Drainage Rate [mL/min] | Basis weight [g/m$^2$] |
|---|---|---|---|---|---|
| 200 | 68.2 | 15.4 | 4.9 | 957 | 45.1 |
| 400 | 70.8 | 22.5 | 6.9 | 1010 | 46.8 |
| 600 | 71.8 | 22.4 | 6.8 | 1070 | 47.5 |
| 800 | 74.2 | 33.0 | 9.7 | 1136 | 49.0 |
| 1000 | 73.7 | 33.8 | 10.0 | 1136 | 48.7 |
| 1200 | 76.1 | 37.9 | 10.9 | 1212 | 50.3 |

TABLE VIII.7

| 250 g/t polymer B = const., dosage of system D = variable | | | | | |
|---|---|---|---|---|---|
| Dosage of System D [g/t] | First Pass Total Retention [%] | First Pass Total Ash Retention [%] | Ash content in sheet [%] | Free Drainage Rate [mL/min] | Basis weight [g/m$^2$] |
| 200 | 72.3 | 33.3 | 10.0 | 1010 | 47.8 |
| 400 | 75.3 | 36.1 | 10.4 | 1136 | 49.8 |
| 600 | 77.8 | 47.0 | 13.2 | 1299 | 51.4 |
| 800 | 77.7 | 50.2 | 14.1 | 1299 | 51.3 |
| 1000 | 79.3 | 51.2 | 14.1 | 1299 | 52.4 |

TABLE VIII.8

| 250 g/t polymer B = const., dosage of system G = variable | | | | | |
|---|---|---|---|---|---|
| Dosage of System G [g/t] | First Pass Total Retention [%] | First Pass Total Ash Retention [%] | Ash content in sheet [%] | Free Drainage Rate [mL/min] | Basis weight [g/m$^2$] |
| 200 | 75.9 | 35.1 | 10.1 | 758 | 50.2 |
| 400 | 78.3 | 42.6 | 11.8 | 909 | 51.8 |
| 600 | 80.5 | 47.1 | 12.8 | 1010 | 53.2 |
| 800 | 80.3 | 49.4 | 13.4 | 1070 | 53.1 |
| 1000 | 81.7 | 58.0 | 15.5 | 1136 | 54.0 |

Example IX

Mechanical Furnish 4 with System A

The examples conducted on mechanical furnish 4 demonstrate that the invention also functions in highly filled mechanical furnishes, such as SC paper grades. In this preferred application of the invention ash retention and free drainage are eminently decoupled, shown with system A and B (see tables IX.1-4 as well as FIGS. 9A and 9B). Therefore example IX is contrary to the highly filled fine paper and DIP furnishes (see examples IV and V), where no decoupling occurs.

TABLE IX.1

| No addition of polymer B, dosage of system A = variable | | | | | |
|---|---|---|---|---|---|
| Dosage of System A [g/t] | First Pass Total Retention [%] | First Pass Total Ash Retention [%] | Ash content in sheet [%] | Free Drainage Rate [mL/min] | Basis weight [g/m$^2$] |
| 200 | 54.8 | 23.6 | 20.7 | 889 | 46.3 |
| 400 | 57.6 | 28.0 | 23.3 | 923 | 48.7 |
| 600 | 61.6 | 33.8 | 26.3 | 1043 | 52.0 |
| 800 | 64.1 | 37.6 | 28.2 | 1043 | 54.1 |
| 1000 | 58.9 | 37.1 | 30.2 | 1091 | 49.8 |
| 1200 | 60.9 | 41.5 | 32.7 | 1143 | 51.4 |

TABLE IX.2

| 250 g/t polymer B = const., dosage of system A = variable | | | | | |
|---|---|---|---|---|---|
| Dosage of System A [g/t] | First Pass Total Retention [%] | First Pass Total Ash Retention [%] | Ash content in sheet [%] | Free Drainage Rate [mL/min] | Basis weight [g/m$^2$] |
| 50 | 54.5 | 23.1 | 20.4 | 750 | 46.0 |
| 100 | 51.7 | 24.1 | 22.4 | 800 | 43.6 |
| 150 | 56.5 | 27.1 | 23.0 | 800 | 47.7 |

TABLE IX.2-continued

| 250 g/t polymer B = const., dosage of system A = variable | | | | | |
|---|---|---|---|---|---|
| Dosage of System A [g/t] | First Pass Total Retention [%] | First Pass Total Ash Retention [%] | Ash content in sheet [%] | Free Drainage Rate [mL/min] | Basis weight [g/m$^2$] |
| 200 | 56.0 | 28.9 | 24.8 | 828 | 47.3 |
| 400 | 59.0 | 37.7 | 30.7 | 923 | 49.8 |

TABLE IX.3

| No addition of polymer B, dosage of system B = variable | | | | | |
|---|---|---|---|---|---|
| Dosage of System B [g/t] | First Pass Total Retention [%] | First Pass Total Ash Retention [%] | Ash content in sheet [%] | Free Drainage Rate [mL/min] | Basis weight [g/m$^2$] |
| 400 | 52.4 | 17.6 | 16.1 | 800 | 44.3 |
| 600 | 50.3 | 19.8 | 18.9 | 889 | 42.5 |
| 800 | 53.9 | 22.3 | 19.9 | 923 | 45.5 |
| 1000 | 56.7 | 26.1 | 22.1 | 1000 | 47.9 |
| 1600 | 57.4 | 27.6 | 23.1 | 1000 | 48.5 |

TABLE IX.4

| 250 g/t polymer B = const., dosage of system B = variable | | | | | |
|---|---|---|---|---|---|
| Dosage of System B [g/t] | First Pass Total Retention [%] | First Pass Total Ash Retention [%] | Ash content in sheet [%] | Free Drainage Rate [mL/min] | Basis weight [g/m$^2$] |
| 50 | 53.7 | 23.1 | 20.6 | 667 | 45.4 |
| 100 | 53.2 | 22.9 | 20.7 | 706 | 45.0 |
| 150 | 55.7 | 25.4 | 21.8 | 774 | 47.1 |
| 200 | 57.9 | 30.2 | 25.1 | 828 | 48.9 |
| 400 | 58.8 | 36.9 | 30.1 | 923 | 49.7 |

Example X

SC Furnish 1 with System A

In example X a single flocculant system (system A) is compared with and without the addition of the anionic branched polymer pre screen in SC furnish 1. It becomes apparent that the addition of the anionic branched polymer decreases the drainage and increases ash retention simultaneously (see FIG. 10). The dosage of system A is reduced which is believed to be due to the number of large aggregates, displayed as counts/second in the 170 to 460 nm fraction, is significantly reduced (see also FIG. 16B).

TABLE X.1

| No addition of polymer B, dosage of system A = variable | | | | | | |
|---|---|---|---|---|---|---|
| Dosage of System A [g/t] | First Pass Total Retention [%] | First Pass Total Ash Retention [%] | Ash content in sheet [%] | Free drainage Rate [mL/min] | 170-460 micron fraction [counts/s] | Basis weight [g/m$^2$] |
| 400 | 55.1 | 29.4 | 28.8 | 159.3 | 18.4 | 60.8 |
| 600 | 58.2 | 35.8 | 33.2 | 181.8 | 30.0 | 64.2 |
| 800 | 62.4 | 41.9 | 36.2 | 206.9 | 37.3 | 68.8 |
| 1000 | 64.2 | 44.3 | 37.2 | 233.8 | 43.6 | 70.7 |

TABLE X.2

| 250 g/t polymer B = const., dosage of system A = variable | | | | | | |
|---|---|---|---|---|---|---|
| Dosage of System A [g/t] | First Pass Total Retention [%] | First Pass Total Ash Retention [%] | Ash content in sheet [%] | Free Drainage Rate [mL/min] | 170-460 micron fraction [counts/s] | Basis weight [g/m$^2$] |
| 150 | 53.3 | 28.7 | 29.0 | 135.3 | 14.3 | 58.8 |
| 200 | 54.9 | 30.9 | 30.4 | 132.4 | 14.1 | 60.5 |
| 250 | 55.1 | 31.8 | 31.2 | 140.6 | 17.3 | 60.7 |
| 300 | 57.3 | 33.9 | 31.9 | 133.3 | 20.7 | 63.2 |
| 350 | 56.9 | 34.4 | 32.7 | 153.8 | 22.5 | 62.7 |
| 400 | 57.4 | 37.3 | 35.1 | 150.0 | 25.6 | 63.2 |

Example XI

SC Furnish 1 with System B

In example XI system B, a premix consisting of 50% polyamine and 50% flocculant is compared with and without the addition of the anionic branched polymer pre screen in SC furnish 1. It becomes apparent that the addition of the anionic branched polymer decreases the drainage and increases retention coevally (see FIG. 11). The dosage of system B, as well as the overall polymer dose is reduced. The number of large aggregates, displayed as counts/second in the 170 to 460 nm fraction, is similar why impacts on formation are unlikely (see also FIG. 16B).

TABLE XI.1

| No addition of polymer B, dosage of system B = variable | | | | | | |
|---|---|---|---|---|---|---|
| Dosage of System B [g/t] | First Pass Total Retention [%] | First Pass Total Ash Retention [%] | Ash content in sheet [%] | Free Drainage Rate [mL/min] | 170-460 micron fraction [counts/s] | Basis weight [g/m$^2$] |
| 400 | 49.4 | 21.2 | 23.2 | 139.5 | 11.3 | 54.4 |
| 600 | 52.6 | 24.0 | 24.6 | 156.5 | 12.5 | 57.9 |
| 800 | 55.7 | 33.7 | 32.7 | 183.7 | 12.6 | 61.4 |
| 1000 | 56.9 | 36.2 | 34.3 | 200.0 | 13.2 | 62.7 |
| 1200 | 58.5 | 37.9 | 35.0 | 214.3 | 13.8 | 64.4 |
| 1400 | 61.8 | 41.2 | 36.1 | 230.8 | 20.2 | 68.1 |

TABLE XI.2

| 250 g/t polymer B = const., dosage of System B = variable | | | | | | |
|---|---|---|---|---|---|---|
| Dosage of System B [g/t] | First Pass Total Retention [%] | First Pass Total Ash Retention [%] | Ash content in sheet [%] | Free Drainage Rate [mL/min] | 170-460 micron fraction [counts/s] | Basis weight [g/m$^2$] |
| 100 | 46.9 | 20.3 | 23.3 | 108.4 | 6.7 | 51.7 |
| 200 | 53.0 | 27.1 | 27.6 | 128.6 | 9.5 | 58.4 |
| 300 | 52.4 | 28.4 | 29.3 | 146.3 | 10.4 | 57.7 |
| 400 | 52.9 | 29.8 | 30.4 | 155.2 | 10.0 | 58.3 |
| 500 | 56.3 | 33.9 | 32.5 | 168.2 | 15.8 | 62.0 |
| 600 | 56.1 | 34.1 | 32.8 | 173.1 | 14.8 | 61.8 |
| 700 | 58.1 | 37.2 | 34.6 | 185.6 | 19.0 | 64.0 |
| 800 | 59.5 | 38.7 | 35.1 | 195.7 | 19.1 | 65.5 |

Example XII

SC Furnish 1 with System C

In example XII system C, a premix consisting of 50% polyethyleneimine and 50% flocculant is compared with and without the addition of the anionic branched polymer pre screen in SC furnish 1. It becomes apparent that the addition of the anionic branched polymer decreases the drainage and increases retention at the same time (see FIG. 12). The dosage of system C, as well as the overall polymer dose is reduced. The number of large aggregates, displayed as counts per second in the 170 to 460 nm fraction, is similar why impacts on formation are unlikely (see also FIG. 16B).

TABLE XII.1

No addition of polymer B, dosage of system C = variable

| Dosage of System C [g/t] | First Pass Total Retention [%] | First Pass Total Ash Retention [%] | Ash content in sheet [%] | Free Drainage Rate [mL/min] | 170-460 micron fraction [counts/s] | Basis weight [g/m$^2$] |
|---|---|---|---|---|---|---|
| 300 | 48.1 | 20.3 | 22.8 | 127.7 | 9.3 | 53.0 |
| 400 | 49.3 | 23.2 | 25.5 | 140.6 | 8.3 | 54.3 |
| 500 | 52.1 | 26.8 | 27.8 | 142.9 | 9.4 | 57.4 |
| 600 | 53.1 | 28.6 | 29.1 | 160.7 | 13.2 | 58.5 |
| 700 | 55.5 | 33.3 | 32.4 | 162.2 | 11.1 | 61.2 |
| 800 | 55.3 | 32.4 | 31.6 | 168.2 | 12.4 | 61.0 |
| 900 | 57.9 | 36.2 | 33.8 | 185.6 | 13.8 | 63.8 |

TABLE XII.2

250 g/t polymer B = const., dosage of system C = variable

| Dosage of System C [g/t] | First Pass Total Retention [%] | First Pass Total Ash Retention [%] | Ash content in sheet [%] | Free Drainage Rate [mL/min] | 170-460 micron fraction [counts/s] | Basis weight [g/m$^2$] |
|---|---|---|---|---|---|---|
| 300 | 54.6 | 31.4 | 31.1 | 140.6 | 15.1 | 60.1 |
| 400 | 56.1 | 33.7 | 32.4 | 137.4 | 14.5 | 61.9 |
| 600 | 59.5 | 37.2 | 33.7 | 168.2 | 14.5 | 65.6 |
| 800 | 59.3 | 39.7 | 36.1 | 187.5 | 17.6 | 65.4 |

Example XIII

SC Furnish 1 with System D

In example XIII system D, a premix consisting of 50% polyDADMAC and 50% flocculant is compared with and without the addition of the anionic branched polymer pre screen in SC furnish 1. It becomes apparent that the addition of the anionic branched polymer decreases the drainage and increases retention coevally (see FIG. 13). The dosage of system D, as well as the overall polymer dose is reduced. The number of large aggregates, displayed as counts per second in the 170 to 460 nm fraction, is similar why impacts on formation are unlikely (see also FIG. 16B).

TABLE XIII.1

No addition of polymer B, dosage of system D = variable

| Dosage of System D [g/t] | First Pass Total Retention [%] | First Pass Total Ash Retention [%] | Ash content in sheet [%] | Free Drainage Rate [mL/min] | 170-460 micron fraction [counts/s] | Basis weight [g/m$^2$] |
|---|---|---|---|---|---|---|
| 600 | 54.8 | 29.9 | 29.4 | 153.8 | 10.7 | 60.4 |
| 800 | 57.5 | 33.5 | 31.5 | 178.2 | 12.5 | 63.3 |
| 1000 | 59.9 | 38.5 | 34.7 | 205.3 | 14.8 | 66.0 |

TABLE XIII.2

| 250 g/t polymer B = const., dosage of system D = variable | | | | | | |
|---|---|---|---|---|---|---|
| Dosage of System D [g/t] | First Pass Total Retention [%] | First Pass Total Ash Retention [%] | Ash content in sheet [%] | Free Drainage Rate [mL/min] | 170-460 micron fraction [counts/s] | Basis weight [g/m$^2$] |
| 300 | 51.7 | 29.6 | 30.9 | 136.4 | 11.3 | 57.0 |
| 400 | 54.3 | 33.0 | 32.8 | 150.0 | 11.8 | 59.9 |
| 500 | 55.2 | 33.9 | 33.2 | 168.2 | 14.5 | 60.8 |
| 600 | 56.5 | 36.2 | 34.6 | 181.8 | 13.7 | 62.3 |
| 700 | 56.8 | 35.9 | 34.2 | 197.8 | 15.2 | 62.6 |

Example XIV

SC Furnish 2 with System B

In example XIV system B, a premix consisting of 50% polyamine and 50% flocculant is compared with and without the addition of the anionic branched polymer pre screen in SC furnish 2. It becomes apparent that the addition of the anionic branched polymer decreases the drainage and increases retention at the same time (see FIG. 14). The dosage of system D, as well as the overall polymer dose is reduced. The number of large aggregates, displayed as counts/second in the 170 to 460 nm fraction, is similar why impacts on formation are unlikely (see also FIG. 16B).

TABLE XIV.1

| No addition of polymer B, dosage of system B = variable | | | | | | |
|---|---|---|---|---|---|---|
| Dosage of System B [g/t] | First Pass Total Retention [%] | First Pass Total Ash Retention [%] | Ash content in sheet [%] | Free Drainage Rate [mL/min] | 170-460 micron fraction [counts/s] | Basis weight [g/m$^2$] |
| 600 | 50.7 | 24.2 | 23.8 | 197.8 | 13.1 | 55.8 |
| 650 | 52.3 | 28.7 | 27.5 | 202.2 | 11.2 | 57.6 |
| 700 | 50.9 | 27.5 | 27.0 | 225.0 | 11.2 | 56.1 |
| 750 | 51.7 | 27.6 | 26.7 | 227.8 | 14.2 | 56.9 |
| 1000 | 56.6 | 33.1 | 29.2 | 253.5 | 17.8 | 62.4 |

TABLE XIV.2

| 250 g/t polymer B = const., dosage of system B = variable | | | | | | |
|---|---|---|---|---|---|---|
| Dosage of System B [g/t] | First Pass Total Retention [%] | First Pass Total Ash Retention [%] | Ash content in sheet [%] | Free Drainage Rate [mL/min] | 170-460 micron fraction [counts/s] | Basis weight [g/m$^2$] |
| 200 | 51.4 | 29.4 | 28.6 | 191.5 | 9.2 | 56.6 |
| 300 | 52.6 | 30.7 | 29.2 | 216.9 | 15.1 | 57.9 |
| 400 | 55.4 | 33.4 | 30.2 | 219.5 | 19.9 | 61.0 |
| 500 | 55.1 | 32.5 | 29.4 | 227.8 | 14.6 | 60.7 |
| 800 | 58.7 | 40.1 | 34.1 | 257.1 | 17.0 | 64.7 |

Example XV

SC Furnish 1 with System E

In example XV system E, a single flocculant is compared with and without the addition of the anionic branched polymer post screen in furnish 1. It becomes apparent that the addition of the anionic branched polymer decreases the drainage concurrently with the increase in retention when it is dosed after the cationic species (see FIG. 15). The dosage of system E, as well as the overall polymer dose is reduced. The number of large aggregates, displayed as counts/second in the 170 to 460 nm fraction, is lower why improvements in formation are likely (see also FIG. 16B).

TABLE XV.1

| No addition of polymer B, dosage of system E = variable | | | | | | |
|---|---|---|---|---|---|---|
| Dosage of System E [g/t] | First Pass Total Retention [%] | First Pass Total Ash Retention [%] | Ash content in sheet [%] | Free Drainage Rate [mL/min] | 170-460 micron fraction [counts/s] | Basis weight [g/m$^2$] |
| 400 | 50.5 | 23.0 | 24.6 | 138.5 | 14.6 | 55.6 |
| 600 | 55.0 | 29.5 | 29.0 | 162.2 | 20.7 | 60.6 |
| 800 | 58.8 | 35.1 | 32.2 | 193.5 | 26.1 | 64.8 |
| 1000 | 60.7 | 38.6 | 34.3 | 211.8 | 33.4 | 66.9 |
| 1200 | 63.6 | 44.4 | 37.7 | 233.8 | 35.1 | 70.1 |

TABLE XV.2

| 200 g/t polymer B = const., dosage of system E = variable | | | | | | |
|---|---|---|---|---|---|---|
| Dosage of System E [g/t] | First Pass Total Retention [%] | First Pass Total Ash Retention [%] | Ash content in sheet [%] | Free Drainage Rate [mL/min] | 170-460 micron fraction [counts/s] | Basis weight [g/m$^2$] |
| 300 | 56.4 | 32.2 | 30.9 | 150.0 | 15.0 | 62.1 |
| 500 | 59.9 | 38.2 | 34.4 | 165.1 | 18.9 | 66.0 |
| 700 | 61.0 | 40.2 | 35.6 | 183.7 | 24.3 | 67.3 |

Example XVI

In addition to the adjustment of an optimum ratio between retention and drainage to facilitate good sheet building, generation of coarse flocs in which event sheet uniformity might be unsatisfactory, should be minimised. FIG. 16A displays an overview about the number of large particles in the 170-460 microns chord length range versus ash content in sheet. It reveals that the gentle flocculation provided with the employment of cat/cat systems in papermaking is not impaired by the addition of the anionic branched polymer prior to the cationic system, here indicated as "pre screen" addition. Indeed, chord length distribution of the single flocculant system A is significantly improved through the addition of polymer B. In respect thereof this order of addition is a preferred form of the invention.

Figure 16B:
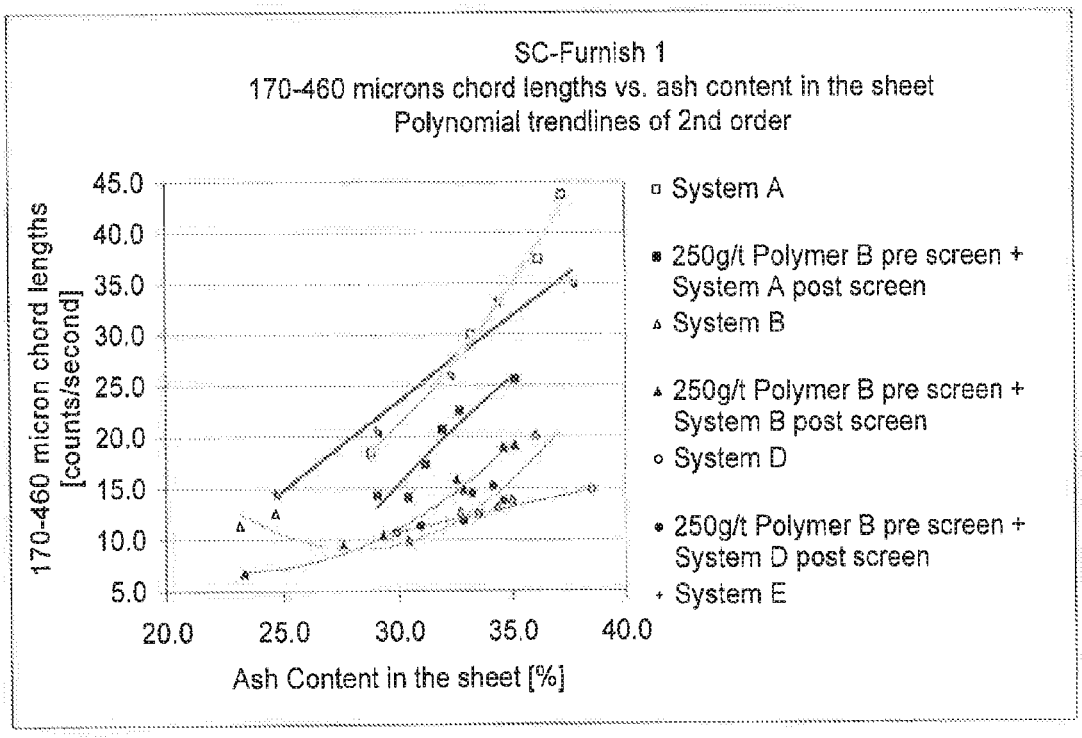
FIG. 16B: A plot of micron chord lengths relative to the percentage of ash content in the sheet.
Figure 17:
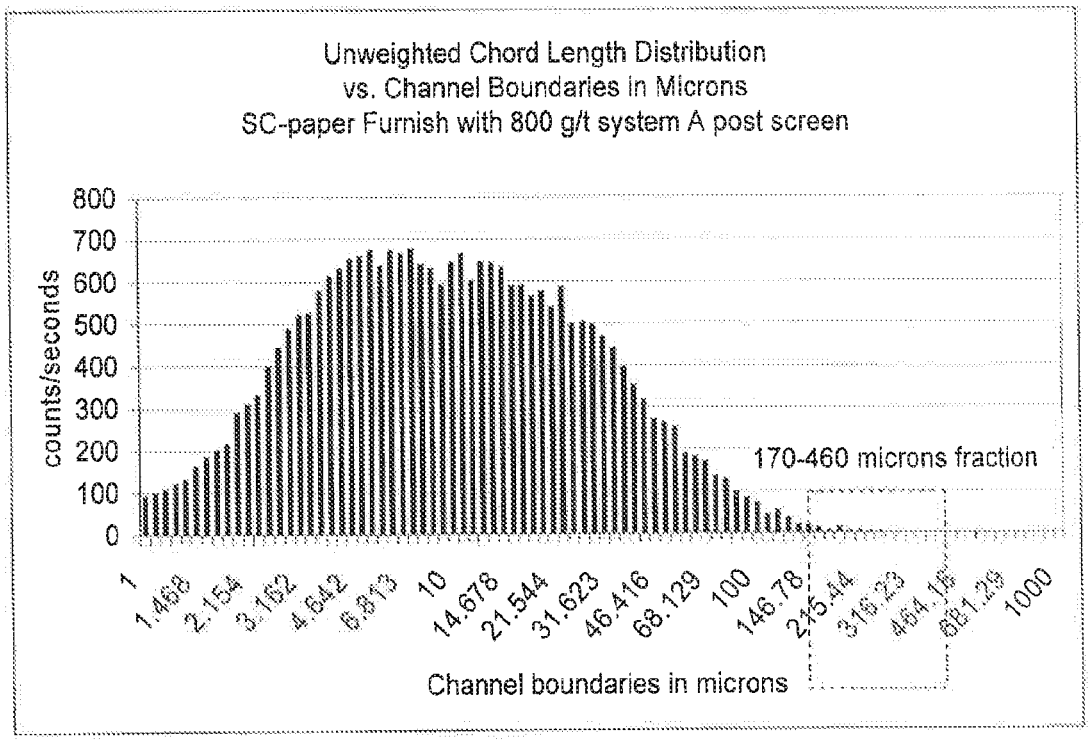
FIG. 17: A plot of unweighted chord length distribution relative to channel boundaries in microns for SC-paper furnish with 800 g/t system A post screen.
Figure 18:
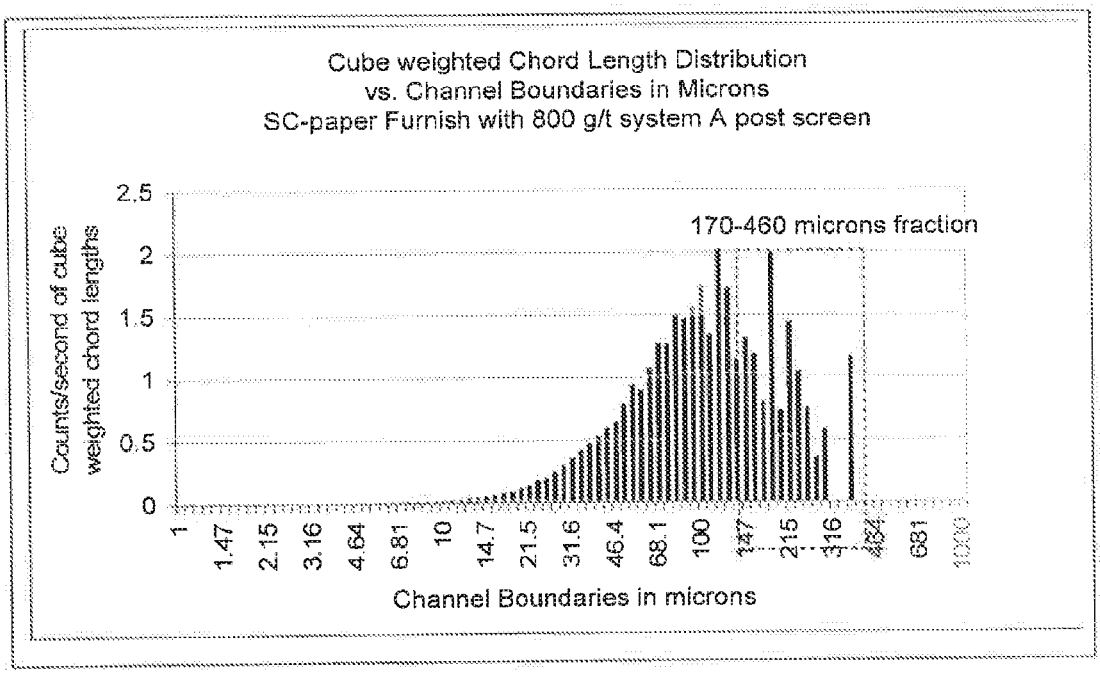
FIG. 18: A plot of cubed weighted chord length distribution relative to channel boundaries in microns for SC-paper furnish with 800 g/t system A post screen.

FIG. 16B shows the number of large particles as cumulative counts per second of cube weighted chord lengths versus chord length channel boundaries. Different flocculating systems are compared at a similar ash levels in the sheet in order to identify the impact of the system on floc size. FIG. 16B restates exemplarily the results of FIG. 16A: The single flocculant system A produces more large flocs than the cat/cat system C with or without the addition of anionic branched polymer B as well as the single polymer system A with addition of the anionic branched polymer B.

The invention claimed is:

1. A process of making filled paper comprising the steps of:

providing a thick stock cellulosic suspension that contains mechanical pulp and filler;

diluting the thick stock cellulosic suspension to form a thin stock suspension, wherein the filler is present in the thin stock suspension in an amount of at least 10% by weight based on a dry weight of the thin stock suspension;

flocculating the thin stock suspension by adding a polymeric retention/drainage system;

draining the thin stock suspension on a screen to form a sheet; and then drying the sheet, thereby making paper, wherein the polymeric retention/drainage system comprises, i) a water-soluble branched anionic polymer; and ii) a water-soluble cationic or amphoteric polymer;

wherein the anionic polymer is present in the thick stock or thin stock suspension prior to the addition of the cationic or amphoteric polymer.

2. The process according to claim 1, in which the water-soluble cationic or amphoteric polymer is a natural polymer or a synthetic polymer that has an intrinsic viscosity of at least 1.5 dl/g.

3. The process according to claim 1, in which the water-soluble cationic or amphoteric polymer is a cationic starch, amphoteric starch, or a synthetic polymer selected from the group consisting of cationic or amphoteric polyacrylamides, polyvinyl amines, and polymers of diallyl dimethyl ammonium chloride.

4. The process according to claim 1, in which the water-soluble cationic or amphoteric polymer; and the cationic coagulant are added to the thick stock cellulosic suspension as a blend.

5. The process according to claim 1, in which the water-soluble branched anionic polymer has:

(a) an intrinsic viscosity above 1.5 dL/g and/or saline Brookfield viscosity of above about 2.0 mPa·s; and (b) a rheological oscillation value of tan delta at 0.005 Hz of above 0.7; and/or (c) a deionised SLV viscosity number which is at least three times a salted SLV viscosity number of a corresponding unbranched polymer made in the absence of a branching agent.

6. The process according to claim 1, in which the water-soluble branched anionic polymer is present in the cellulosic suspension before the addition of the water-soluble cationic or amphoteric polymer.

7. The process according to claim 1, in which the thick stock cellulosic suspension containing the water-soluble branched anionic polymer is subjected to at least one stage that brings about mechanical degradation prior to the addition of the water-soluble cationic or amphoteric polymer.

8. The process according to claim 1, wherein the flocculating step comprises adding the water-soluble branched anionic polymer to the thin stock; shearing the thin stock containing the water-soluble branched anionic polymer using a centriscreen; and adding the water-soluble cationic or amphoteric polymer and the cationic coagulant to the cellulosic suspension containing the water-soluble branched anionic polymer after the centriscreen shearing step.

9. The process according to claim 1, in which a filled paper is super calendared paper (SC-paper).

10. The process according to claim 1, in which the mechanical pulp is selected from the group consisting of stone-ground wood (SGW), pressurised ground wood (PGW), thermomechanical pulp (TMP), chemithermomechanical pulp (CTMP), bleached Chemi-Thermo Mechanical Pulp (BCTMP), and mixtures thereof.

11. The process according to claim 1, in which a mechanical pulp content is between 10 and 75% by the dry weight of cellulosic suspension.

12. The process according to claim 1, in which the filler is selected from the group consisting of calcium carbonate, titanium dioxide, and kaolin.

13. The process according to claim 1, in which the filler present in the cellulosic suspension prior to draining is at least 30% by weight based on the dry weight of cellulosic suspension.

14. The process according to claim 1, which process is carried out on a GAP former paper machine or other twin wire paper machine.

15. A process of making filled paper comprising the steps of:

providing a thick stock cellulosic suspension that contains mechanical pulp and filler;

diluting the thick stock cellulosic suspension to form a thin stock suspension, wherein the filler is present in the thin stock suspension in an amount of at least 10% by weight based on a dry weight of the thin stock suspension;

flocculating the thin stock suspension by adding a polymeric retention/drainage system;

draining the thin stock suspension on a screen to form a sheet; and then drying the sheet, thereby making paper, wherein the polymeric retention/drainage system comprises, i) a water-soluble branched anionic polymer;

ii) a water-soluble cationic or amphoteric polymer; and iii) a cationic coagulant from 0.2 to 0.5% by weight of a cellulosic fibre, wherein the cationic coagulant is a synthetic polymer of intrinsic viscosity up to 3 dl/g and exhibiting a cationic charge density of greater than 3 meq/g, wherein the anionic polymer is present in the thick stock or thin stock suspension prior to the addition of the cationic or amphoteric polymer.

16. A process of making filled paper comprising the steps of:

providing a thick stock cellulosic suspension that contains mechanical pulp and filler;

diluting the thick stock cellulosic suspension to form a thin stock suspension, wherein the filler is present in the thin stock suspension in an amount of at least 10% by weight based on a dry weight of the thin stock suspension;

flocculating the thin stock by adding a polymeric retention/drainage system;

draining the thin stock suspension on a screen to form a sheet; and then drying the sheet, wherein the polymeric retention/drainage system comprises, i) a water-soluble branched anionic polymer; and ii) a water-soluble cationic or amphoteric polymer, wherein the anionic polymer is present in the thick stock cellulosic suspension or thin stock suspension prior to the addition of the water-soluble cationic or amphoteric polymer, and wherein the process for making a filled paper excludes clay.

* * * * *